US011342663B2

(12) United States Patent
Kim et al.

(10) Patent No.: US 11,342,663 B2
(45) Date of Patent: May 24, 2022

(54) ANTENNA APPARATUS

(71) Applicant: Samsung Electro-Mechanics., Ltd., Suwon-si (KR)

(72) Inventors: Nam Ki Kim, Suwon-si (KR); Jeong Ki Ryoo, Suwon-si (KR); Kyu Bum Han, Suwon-si (KR); Young Kyoon Im, Suwon-si (KR); Won Cheol Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 259 days.

(21) Appl. No.: 16/437,630

(22) Filed: Jun. 11, 2019

(65) Prior Publication Data

US 2020/0220268 A1 Jul. 9, 2020

(30) Foreign Application Priority Data

Jan. 4, 2019 (KR) ..... 10-2019-0001344
Mar. 5, 2019 (KR) ..... 10-2019-0025312

(51) Int. Cl.

| | |
|---|---|
| ***H01Q 1/52*** | (2006.01) |
| ***H01Q 21/00*** | (2006.01) |
| ***H01Q 9/06*** | (2006.01) |
| ***H01Q 9/26*** | (2006.01) |
| ***H01Q 21/29*** | (2006.01) |
| *H01Q 1/24* | (2006.01) |

(52) U.S. Cl.

CPC ..... *H01Q 1/523* (2013.01); *H01Q 9/065* (2013.01); *H01Q 9/26* (2013.01); *H01Q 21/0006* (2013.01); *H01Q 21/29* (2013.01); *H01Q 1/243* (2013.01)

(58) Field of Classification Search

CPC .. H01Q 9/16; H01Q 9/20; H01Q 9/26; H01Q 9/265; H01Q 9/28; H01Q 9/285; H01Q 9/065

See application file for complete search history.

(56) References Cited

U.S. PATENT DOCUMENTS 10,033,100 B1 * 7/2018 Chayat ..... H01Q 5/30
10,153,556 B2 * 12/2018 Ganchrow ..... H01Q 1/50
2011/0285474 A1 * 11/2011 Ali ..... H01P 5/10 333/33

(Continued)

FOREIGN PATENT DOCUMENTS

CN 101075702 A 11/2007
EP 2369677 A1 * 9/2011 ..... H01Q 19/00

(Continued)

OTHER PUBLICATIONS

Korean Office Action dated Oct. 11, 2019 in counterpart Korean Patent Application No. 10-2019-0025312 (4 pages in English and 4 pages in Korean).

*Primary Examiner* — Daniel Munoz
(74) *Attorney, Agent, or Firm* — NSIP Law

(57) ABSTRACT

An antenna apparatus includes: a first dipole antenna pattern; a feed line electrically connected to the first dipole antenna pattern; and a first ground plane disposed rearward of the first dipole antenna pattern and spaced apart from the first dipole antenna pattern; wherein the first ground plane forms a step-type cavity, and width of a rear portion of the step-type cavity is different from a width of a front portion of the step-type cavity.

20 Claims, 17 Drawing Sheets

(56) References Cited

U.S. PATENT DOCUMENTS

| | | | |
|---|---|---|---|
| 2016/0294052 | A1 | 10/2016 | Baek et al. |
| 2018/0261906 | A1 | 9/2018 | Hill et al. |

FOREIGN PATENT DOCUMENTS

| | | | |
|---|---|---|---|
| KR | 10-2013-0068782 | A | 6/2013 |
| KR | 10-2015-0130046 | A | 11/2015 |
| KR | 10-2016-0105870 | A | 9/2016 |
| WO | WO 2015/105605 | A1 | 7/2015 |

* cited by examiner

ANTENNA APPARATUS

CROSS-REFERENCE TO RELATED APPLICATIONS

This application claims benefit of Korean Patent Application Nos. 10-2019-0001344 and 10-2019-0025312 filed on Jan. 4, 2019 and Mar. 5, 2019, respectively, in the Korean Intellectual Property Office, the entire disclosures of which are incorporated herein by reference for all purposes.

BACKGROUND

1. Field

The following description relates to an antenna apparatus.

2. Description of Related Art

Mobile communications data traffic has increased on an annual basis. Various techniques have been developed to support the rapid increase in data in a wireless network in real time. For example, conversion of Internet of Things (IoT)-based data into contents, such as augmented reality (AR), virtual reality (VR), live VR/AR linked with SNS, an automatic driving function, applications such as a sync view (transmission of real-time images from a user viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

An RF signal of a high frequency band (e.g., 24 GHz, 28 GHz, 36 GHz, 39 GHz, 60 GHz, and the like) may easily be absorbed and lost during transmission, and quality of communications may be degraded. Thus, an antenna for communications performed in a high frequency band may require a technical approach different from techniques used in a general antenna, and a special configuration such as a separate power amplifier, and the like, may be required to secure antenna gain, integration of an antenna and an RFIC, effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a first dipole antenna pattern; a feed line electrically connected to the first dipole antenna pattern; and a first ground plane disposed rearward of the first dipole antenna pattern and spaced apart from the first dipole antenna pattern, wherein the first ground plane forms a step-type cavity, and a width of a rear portion of the step-type cavity is different from a width of a front portion of the step-type cavity.

The antenna apparatus may further include: a second ground plane disposed above or below the first ground plane and forming the step-type cavity; and shielding vias disposed along a front boundary line of the first ground plane and electrically connected to the second ground plane.

The antenna apparatus may further include: a first blocking pattern disposed outside of the step-type cavity and extending from the first ground plane to a region in front of the first ground plane; and a second blocking pattern disposed in outside of the step-type cavity and extending from the second ground plane to a region in front of the second ground plane, and overlapping the first blocking pattern in upward and downward directions.

The antenna apparatus may further include: a third ground plane disposed above or below the first ground plane and forming the step-type cavity; a second dipole antenna pattern disposed above or below the first dipole antenna pattern; and a radial via electrically connecting the first dipole antenna pattern and the second dipole antenna pattern to each other.

The antenna apparatus may further include: a first feed via electrically connecting the feed line and the first dipole antenna pattern; and a director pattern disposed in the front of the second dipole antenna pattern and spaced apart from the second dipole antenna pattern. A front region of the first dipole antenna pattern overlapping the director pattern in upward and downward directions may be filled with an insulating layer.

The step-type cavity may be configured such that virtual extension lines of side boundary lines in the rear portion of the step-type cavity intersect the first dipole antenna pattern.

The antenna apparatus may further include: a director pattern disposed in front of the first dipole antenna pattern and spaced apart from the first dipole antenna pattern. The step-type cavity may be configured such that the virtual extension lines of the side boundary lines in the rear portion of the step-type cavity intersect the director pattern.

The step-type cavity may be configured such that virtual extension lines of side boundary lines in the front portion of the step-type cavity intersect the first dipole antenna pattern and do not intersect the director pattern.

The antenna apparatus may further include: a first blocking pattern disposed outside of the step-type cavity and extending further than the feed line in the first ground plane.

Lengths of side boundary lines in the front portion of the step-type cavity may be shorter than lengths of side boundary lines in the rear portion of the step-type cavity.

The first ground plane may protrude from a region between side boundary lines in the rear portion of the step-type cavity, and may protrude further than the side boundary lines in the rear portion of the step-type cavity.

The antenna apparatus may further include: a fourth ground plane disposed above the first ground plane, overlapping the step-type cavity in upward downward directions, and including a through-hole; a patch antenna pattern disposed above of the fourth ground plane; and a second feed via electrically connected to the patch antenna pattern and penetrating the through-hole.

In another general aspect, an antenna apparatus includes: a first dipole antenna pattern; a feed line electrically connected to the first dipole antenna pattern; and a first ground plane disposed rearward of the first dipole antenna pattern and spaced apart from the first dipole antenna pattern, wherein the first ground plane forms first and second cavities recessed rearwardly into the first ground plane and having a T shape and an L shape, respectively.

The antenna apparatus may further include: a second ground plane disposed above or below the first ground plane and forming the first and second cavities; and shielding vias arranged along a front boundary line of the first ground plane and electrically connected to the second ground plane.

The antenna apparatus may further include: a third ground plane disposed above or below the first ground plane and forming the first and second cavities; a second dipole antenna pattern disposed above or below the first dipole antenna pattern; and a radial via electrically connecting the first dipole antenna pattern and the second dipole antenna pattern to each other.

The antenna apparatus may further include: a fourth ground plane disposed above the first ground plane, overlapping the first and second cavities in upward and downward directions, and including a through-hole; a patch antenna pattern disposed above the fourth ground plane; and a second feed via electrically connected to the patch antenna pattern and penetrating the through-holes.

In another general aspect, an antenna apparatus includes: a dipole antenna pattern; a feed line electrically connected to the first dipole antenna pattern; and vertically stacked ground layers spaced apart from the dipole antenna pattern in a first horizontal direction, and including edge portions forming a cavity facing the dipole antenna pattern. The cavity includes a first cavity portion spaced from the dipole antenna pattern in the first horizontal direction, and a second cavity portion disposed between dipole antenna pattern and the first cavity portion in the first horizontal direction. A width of the second cavity portion in a second horizontal direction perpendicular to the first horizontal direction is greater than a width of the first cavity portion in the second horizontal direction.

The antenna apparatus may further include protrusions disposed at opposite sides of one or more of the edge portions, wherein the protrusions define the second cavity portion.

The antenna apparatus may further include protrusions disposed in the cavity at a central region of one or more of the edge portions.

The cavity may have a step shape in a plane of the first and second horizontal directions.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
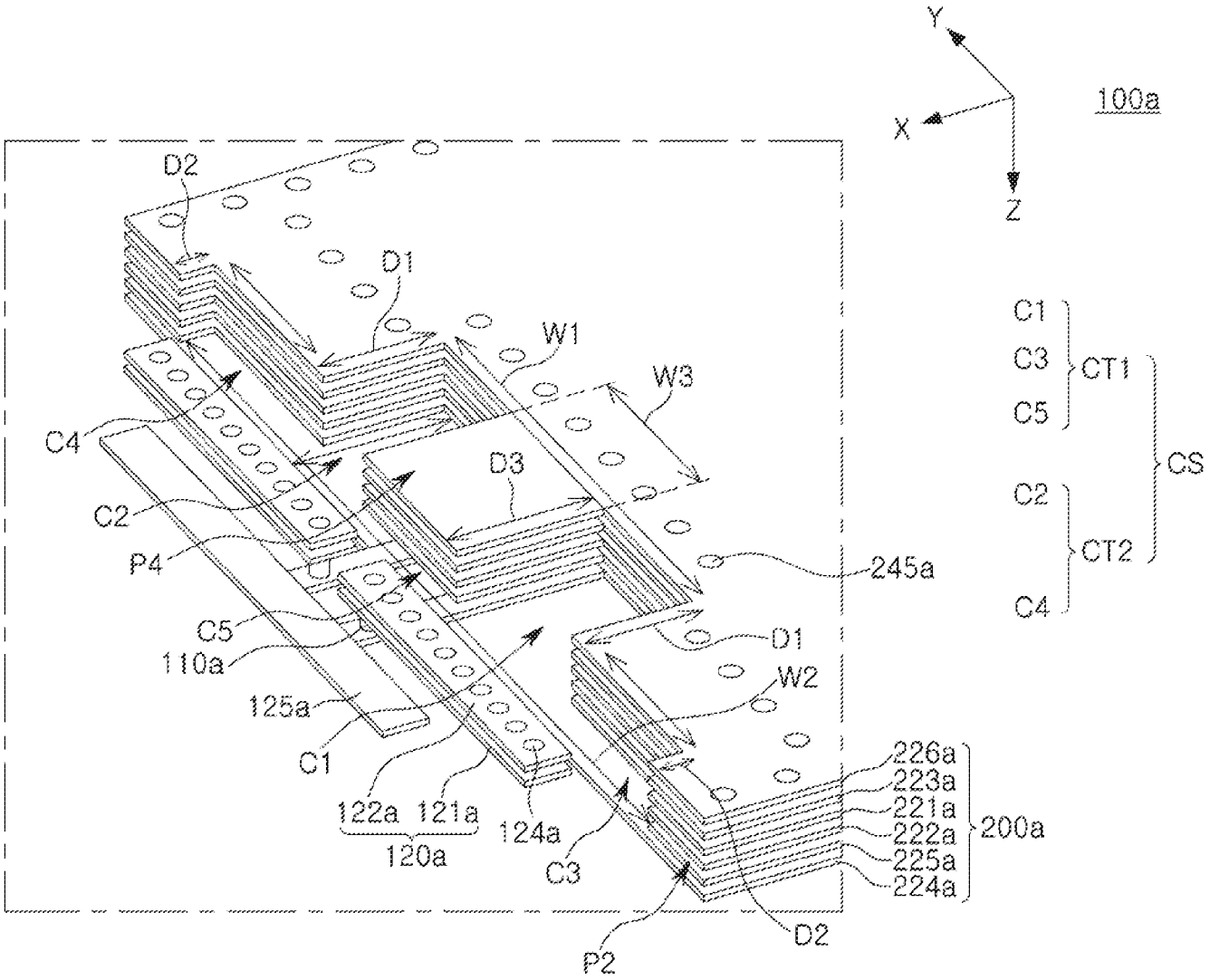
FIGS. 1A and 1B are perspective diagrams illustrating an antenna apparatus, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
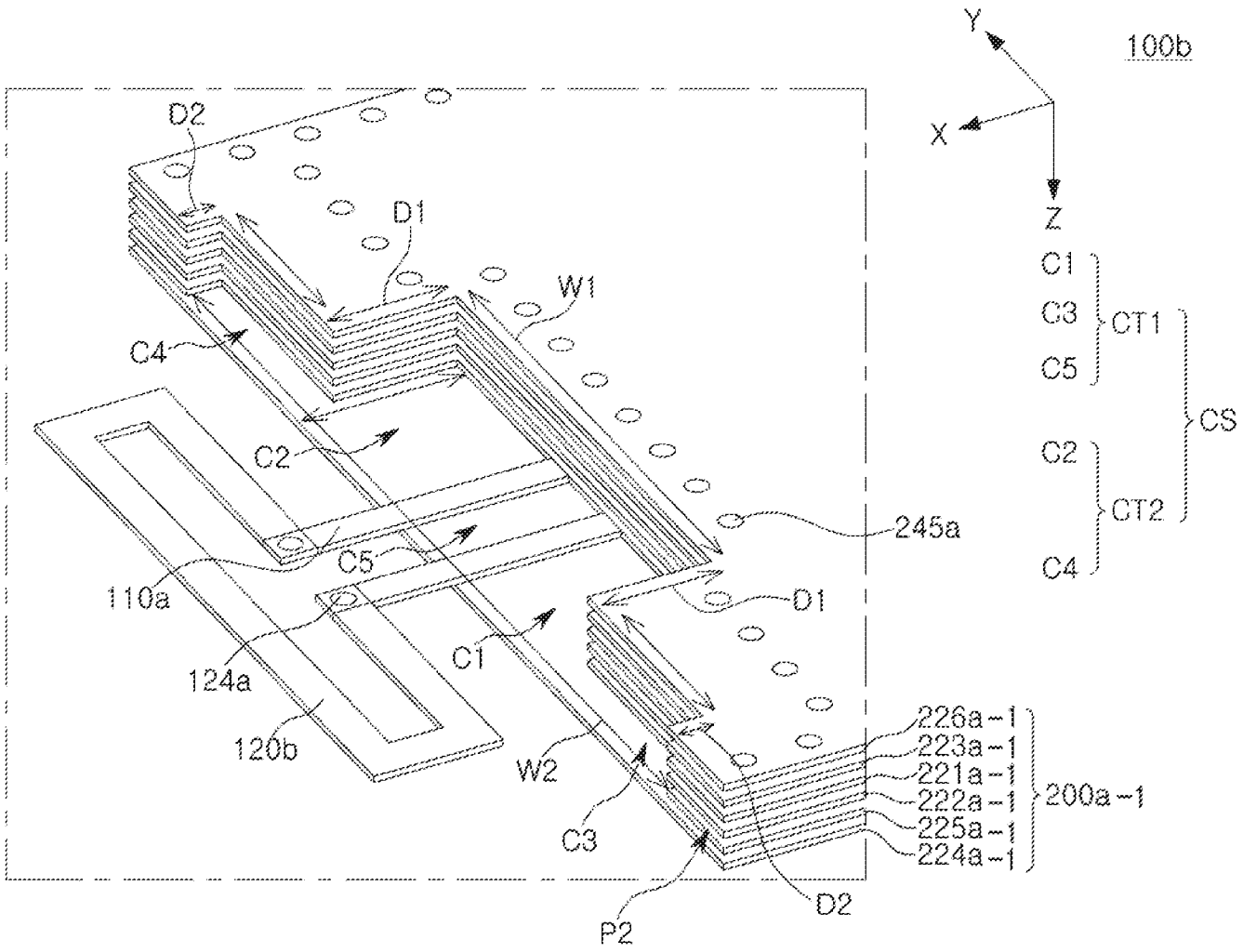
Figure 2:
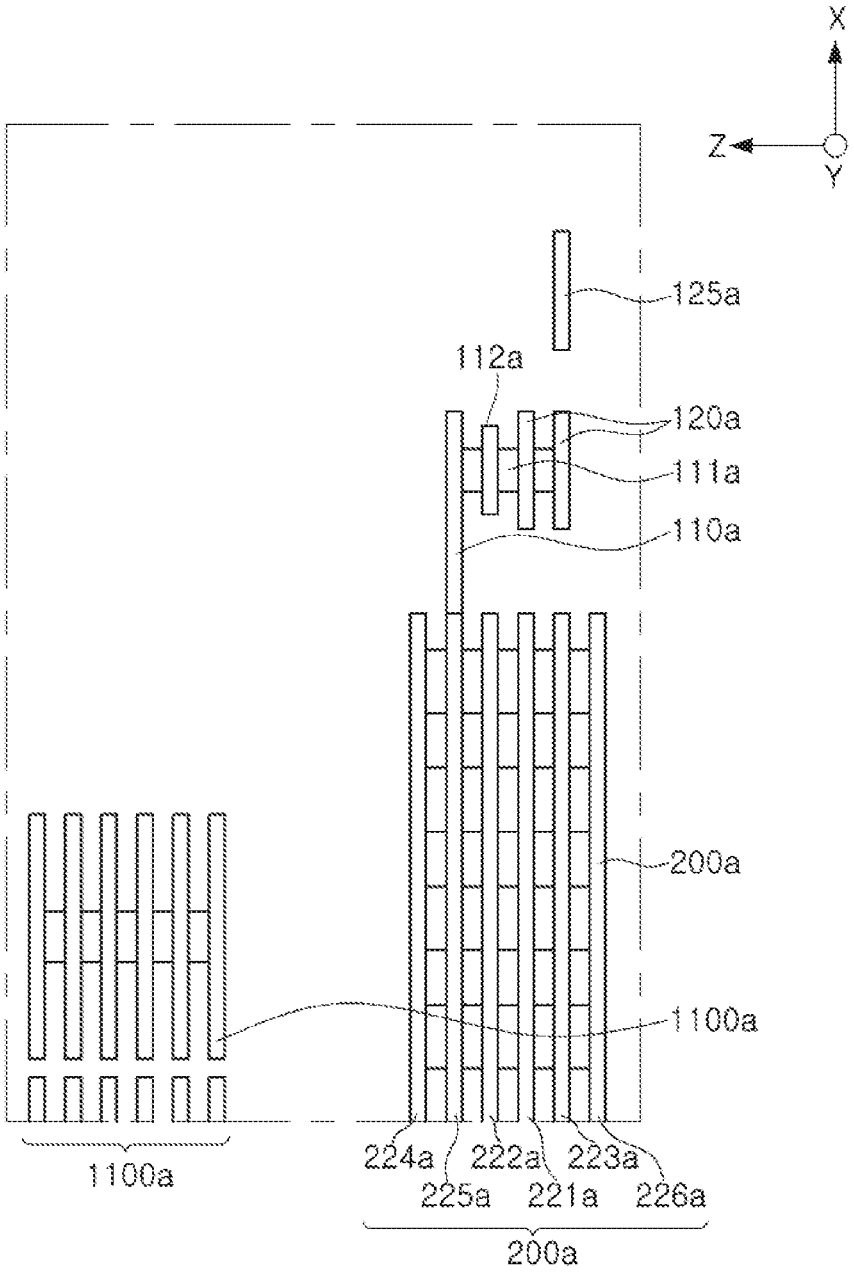
FIG. 2 is a lateral view of the antenna apparatus of FIG. 1A.

FIGS. 1A and 1B are perspective diagrams illustrating antenna apparatuses 100*a* and 100*b*, respectively, according to an embodiment. FIG. 2 is a lateral view of the antenna apparatus of FIG. 1A.

Referring to FIGS. 1A and 2, an antenna apparatus 100*a* may include a dipole antenna pattern 120*a* and a connection member 200*a*. The dipole antenna pattern 120*a* may receive a radio frequency (RF) signal from the connection member 200*a* via a feed line 110*a* and may remotely transmit the signal in an x direction, or may remotely receive an RF signal in an x direction and may transfer the signal to the connection member 200*a* via the feed line 110*a*. The dipole antenna pattern 120*a* may have a structure in which two poles extend in a y direction.

The connection member 200*a* may include at least portions of a first ground layer or ground plane 221*a*, a second ground layer or ground plane 222*a*, a third ground layer or ground plane 223*a*, a fourth ground layer or ground plane 224*a*, a fifth ground layer or ground plane 225*a*, and a sixth ground layer or ground plane 226*a*, and may further include an insulating layer disposed between the plurality of ground planes. The first to sixth ground planes 221*a*, 222*a*, 223*a*, 224*a*, 225*a*, and 226*a* may be spaced apart from each other in upward and downward directions (a z direction), and may extend in respective lateral planes (x and y directions).

The antenna apparatus 100*a* may include at least one of the first to sixth ground planes 221*a*, 222*a*, 223*a*, 224*a*, 225*a*, and 226*a*. The numbers and upward and down relations of the first to sixth ground planes 221*a*, 222*a*, 223*a*, 224*a*, 225*a*, and 226*a* may vary depending on a design of the antenna apparatus 100*a*.

The specific configurations of the first to sixth ground planes 221*a*, 222*a*, 223*a*, 224*a*, 225*a*, and 226*a* and the specific configurations of other ground planes may be replaceable with each other.

The first, third, and sixth ground planes 221*a*, 223*a*, and 226*a* may provide grounds used in a circuit of an IC and/or a passive component as an IC and/or a passive component. The first, third, and sixth ground planes 221*a*, 223*a*, and 226*a* may provide a transfer pathway for power and a signal used in an IC and/or a passive component. Thus, the first, third, and sixth ground planes 221*a*, 223*a*, and 226*a* may be electrically connected to an IC and/or a passive component.

The first, third, and sixth ground planes 221*a*, 223*a*, and 226*a* may be omitted depending on ground consumption of the IC and/or the passive component. The first, third, and sixth ground planes 221*a*, 223*a*, and 226*a* may have through-holes through which wiring vias penetrate.

The fifth ground plane 225*a* may be disposed in upper levels of the first, third, and sixth ground planes 221*a*, 223*a*, and 226*a* and may be spaced apart from the first, third, and sixth ground planes 221*a*, 223*a*, and 226*a*, and may surround a wiring line at a height the same as a height of the wiring line in which an RF signal flows. The wiring line may be electrically connected to the IC via the wiring via.

The second and fourth ground planes 222*a* and 224*a* may be disposed above the first, third, and sixth ground planes 221*a*, 223*a*, and 226*a*, and may be spaced apart from the first, third, and sixth ground planes 221*a*, 223*a*, and 226*a*, and may be disposed below and above the fifth ground plane 225*a*, respectively. The second ground plane 222*a* may improve electromagnetic isolation between the wiring line and the IC, and may provide a ground to an IC and/or a passive component. The fourth ground plane 224*a* may improve electromagnetic isolation between a wiring line and a patch antenna pattern, and may provide a boundary condition in view of the patch antenna pattern, and may reflect an RF signal transmitted and received by the patch antenna pattern such that transmission and reception directions of the patch antenna pattern may further be concentrated. The patch antenna pattern may be included in a patch antenna package 1100*a*. The patch antenna package 1100*a* may be disposed in an upper level of the connection member 200*a*, and may be electrically connected to a wiring line in the connection member 200*a* through a second feed via.

The fourth ground plane 224*a* may be configured to overlap first and second cavities CT1 and CT2 of the first, second, third, fifth, and sixth ground planes 221*a*, 222*a*, 223*a*, 225*a*, and 226*a* in upward and downward directions (a z direction). Accordingly, electromagnetic isolation between the dipole antenna pattern 120*a* and the patch antenna pattern may further improve.

Boundaries of the first, second, third, fifth, and sixth ground planes 221*a*, 222*a*, 223*a*, 225*a*, and 226*a* may overlap with each other in upward and downward directions (a z direction). The boundaries may work as a reflector for the dipole antenna pattern 120*a*, and thus, an effective separation distance between the first, second, third, fifth, and sixth ground planes 221*a*, 222*a*, 223*a*, 225*a*, and 226*a* and the dipole antenna pattern 120*a* may affect antenna performance of the dipole antenna pattern 120*a*.

For example, when the effective separation distance is shorter than a reference distance, a gain of the dipole antenna pattern 120*a* may be deteriorated as RF signals penetrating the dipole antenna pattern 120*a* are distributed, and it may be difficult to optimize a resonance frequency of the dipole antenna pattern 120*a* as capacitance between the first, second, third, fifth, and sixth ground planes 221*a*, 222*a*, 223*a*, 225*a*, and 226*a* and the dipole antenna pattern 120*a* increases. Accordingly, a compensation interference ratio between RF signals penetrating the dipole antenna pattern 120*a* in an x direction and RF signals being reflected from the first, second, third, fifth, and sixth ground planes 221*a*, 222*a*, 223*a*, 225*a*, and 226*a* may decrease.

When the dipole antenna pattern 120*a* is spaced away from the first, second, third, fifth, and sixth ground planes 221*a*, 222*a*, 223*a*, 225*a*, and 226*a*, a size of the antenna apparatus may increase.

When a size of the connection member 200*a* decreases, a transfer pathway for power and a signal, and a space in which wiring lines are disposed may decrease, ground stability of the ground planes may be deteriorated, and a space in which the patch antenna pattern is disposed may also decrease. In other words, performance of an antenna apparatus may be deteriorated.

The antenna apparatus 100*a* may have a structure in which the dipole antenna pattern 120*a* may be disposed adjacent to the first, second, third, fifth, and sixth ground planes 221*a*, 222*a*, 223*a*, 225*a*, and 226*a*, and an effective separation distance between the first, third, fourth and fifth ground planes 221*a*, 223*a*, 224*a*, and 225*a* and the dipole antenna pattern 120*a* may be provided. Accordingly, the antenna apparatus may be reduced in size or may have improved performance.

One or more of the first, second, third, fifth, and sixth ground planes 221*a*, 222*a*, 223*a*, 225*a*, and 226*a* included in the connection member 200*a* may have a first protrusion region P4 protruding towards the dipole antenna pattern 120*a* to overlap at least a portion of the feed line 110*a* in upward and downward directions (a z direction), and second protrusion regions P2 protruding at a position in which the second protrusion regions P2 are spaced apart from the first protrusion region P4 in first and second lateral directions (e.g., a y direction).

Due to the first and second protrusion regions P4 and P2, a boundary of at least one of the first, second, third, fifth, and sixth ground planes 221*a*, 222*a*, 223*a*, 225*a*, and 226*a* facing the dipole antenna pattern 120*a* may have a serrated structure. Thus, the first and second cavities CT1 and CT2 may be formed between the first protrusion region P4 and the second protrusion regions P2. The first and second cavities CT1 and CT2 may provide boundary conditions which may provide antenna performance of the dipole antenna pattern 120*a*.

The boundary of one or more of the first, second, third, fifth, and sixth ground planes 221*a*, 222*a*, 223*a*, 225*a*, and 226*a* facing the dipole antenna pattern 120*a* may work as a reflector for the dipole antenna pattern 120*a*, and thus, portions of RF signals penetrating the dipole antenna pattern 120*a* may be reflected from one or more of the boundaries of the first, second, third, fifth, and sixth ground planes 221*a*, 222*a*, 223*a*, 225*a*, and 226*a*.

The first and second cavities CT1 and CT2 may have a structure formed by respective recessed portions of front edges of the first, second, third, fifth, and sixth ground planes 221*a*, 222*a*, 223*a*, 225*a*, and 226*a* that face the dipole antenna pattern 120*a*. The respective recessed portions are recessed, with respect to remaining portions of the front edges, in a lateral direction (an x direction) away from the dipole antenna pattern 120*a*. The first cavity CT1 is disposed between first and second ends of a first pole of the dipole antenna pattern 120*a*, and the second cavity CT2 is formed between first and second ends of a second pole of the dipole antenna pattern 120*a*. Thus, the first and second cavities CT1 and CT2 may work as a reflector for the first and second poles of the dipole antenna pattern 120*a*.

Accordingly, an effective separation distance to at least one of the first, second, third, fifth, and sixth ground planes 221*a*, 222*a*, 223*a*, 225*a*, and 226*a* from each pole of the dipole antenna pattern 120*a* may be elongated without substantially changing a position of the dipole antenna pattern 120*a*. Alternatively, the dipole antenna pattern 120*a* may be disposed adjacent to the first, second, third, fifth, and sixth ground planes 221*a*, 222*a*, 223*a*, 225*a*, and 226*a* without substantially sacrificing antenna performance.

For example, RF signals directed to the first and second cavities CT1 and CT2 among RF signals penetrating at each pole of the dipole antenna pattern 120*a* may be more concentrated in an x direction and reflected more than in an example in which the first and second cavities CT1 and CT2 are not provided. Thus, a gain of the dipole antenna pattern 120*a* may further improve, as compared to an example in which the first and second cavities CT1 and CT2 are not provided.

For example, capacitance between each pole of the dipole antenna pattern 120*a* and the first, second, third, fifth, and sixth ground planes 221*a*, 222*a*, 223*a*, 225*a*, and 226*a* may decrease further than in an example in which the first and second cavities CT1 and CT2 are not provided. Thus, a resonance frequency of the dipole antenna pattern 120*a* may easily be optimized.

Also, the first protrusion region P4 may provide an additional resonance point in accordance with electromagnetic coupling between the first protrusion region P4 and the dipole antenna pattern 120*a*. The resonance point may be dependent on a configuration of the first protrusion region P4 (e.g., a width, a length, a thickness, an isolation distance to the second protrusion region P2, an isolation distance to the dipole antenna pattern 120*a*, and the like).

When the additional resonance point is adjacent to a frequency band of the dipole antenna pattern 120*a*, a bandwidth of the dipole antenna pattern 120*a* may expand. Also, the additional resonance point may support an additional frequency band of the dipole antenna pattern 120*a* and may enable multi-band communications of the dipole antenna pattern 120*a*. Thus, the first protrusion region P4 may expand a bandwidth of the dipole antenna pattern 120*a* or may expand a communication band of the dipole antenna pattern 120*a*.

The second protrusion regions P2 may electromagnetically shield a space between the dipole antenna pattern 120*a* and an adjacent antenna apparatus. Accordingly, an isolation distance between the dipole antenna pattern 120*a* and an adjacent antenna apparatus may further decrease, and a size of the antenna module may be reduced.

The connection member 200*a* may further include shielding vias 245*a* electrically connected to at least two of the first, second, third, fifth, and sixth ground planes 221*a*, 222*a*, 223*a*, 225*a*, and 226*a*, and surrounding at least a portion of each of the first and second cavities CT1 and CT2 in upward and downward directions (a z direction).

The shielding vias 245*a* may reflect RF signals leaking from gaps between the first, second, third, fifth, and sixth ground planes 221*a*, 222*a*, 223*a*, 225*a*, and 226*a* among RF signals penetrating the dipole antenna pattern 120*a*. Accordingly, a gain of the dipole antenna pattern 120*a* may further improve, and electromagnetic isolation between the dipole antenna pattern 120*a* and wiring lines may improve.

When the first protrusion region P4 is omitted, the first and second cavities CT1 and CT2 may form a single cavity. Thus, the first and second cavities CT1 and CT2 may be in contact with each other.

A third length D3 of the first protrusion region P4 may be elongated such that the first protrusion region P4 may protrude in the x direction toward the dipole antenna pattern 120*a* further than the second protrusion regions P2. Accordingly, the first protrusion region P4 may be firmly coupled to the dipole antenna pattern 120*a* and may further expand a bandwidth of the dipole antenna pattern 120*a*. A third width W3 of the first protrusion region P4 may affect a bandwidth of the dipole antenna pattern 120*a*.

The first cavity CT1 may include a first cavity portion C1, a second cavity portion C3, and a third cavity portion C5, and the second cavity CT2 may include a fourth cavity portion C2 and a fifth cavity portion C4.

The first cavity CT1 may have a T form, as the first cavity CT1 includes the first cavity portion C1, second cavity portion C3, and the third cavity portion C5. The second cavity CT2 may have an L form, as the second cavity CT2 includes the fourth cavity portion C2 and the fifth cavity portion C4. Forms of the first and second cavities CT1 and CT2 may not be limited to a T form and an L form, and both of the first and second cavities CT1 and CT2 may be an L form or may be a T form.

The second cavity portion C3 may be disposed between the first cavity portion C1 and one of the second protrusion regions P2, and may be configured to expand in a −y direction from the first cavity portion C1.

The fifth cavity portion C4 may be disposed between the fourth cavity portion cavity C2 and the other one of the second protrusion regions P2, and may be configured to expand in a +y direction from the fourth cavity portion C2.

A step-type cavity CS may include the first and second cavities CT1 and CT2, and may have two or more recessed portions such that the step-type cavity CS may have two side boundary lines in the rear, forming a first depth D1, and may have two side boundary lines in the front, forming a second depth D2.

Thus, the step-type cavity CS may have a structure in which a rear width W1 is different from a front width W2.

A recess depth of the first cavity portion C1 and the fourth cavity portion C2 may be a sum of first and second depths (D1+D2), and thus, the recess depth of the first cavity portion C1 and the fourth cavity portion C2 may be longer than the second depth D2, a recess depth of the second cavity portion C3 and the fifth cavity portion C4. Thus, an isolation distance, measured in an x direction, between boundaries of the first to sixth ground planes 221*a*, 222*a*, 223*a*, 224*a*, 225*a*, and 226*a* and an end portion of the dipole antenna pattern 120*a*, with respect to a y direction, may be shorter than an isolation distance, measured in an x direction, between the boundaries of the first to sixth ground planes 221*a*, 222*a*, 223*a*, 224*a*, 225*a*, and 226*a* and a central portion of the dipole antenna pattern 120*a*, with respect to a y direction.

As a transmission direction of RF signals in a conductive medium is greatly changed between the dipole antenna pattern 120*a* and the feed line 110*a*, RF signals may penetrate more towards air or a dielectric medium (e.g., a dielectric layer, an insulating layer) in a central portion of the dipole antenna pattern 120*a* in a y direction.

An isolation distance, in an x direction, between boundaries of the first, second, third, fifth, and sixth ground planes 221*a*, 222*a*, 223*a*, 225*a*, and 226*a* and the dipole antenna pattern 120*a* may be affected more greatly by an isolation distance, in an x direction, at a central portion of the boundaries with respect to a y direction, than by an isolation distance, in an x direction, at an end portion of the boundaries with respect to a y direction.

Thus, a sum of the first and second depths of the first cavity portion C1 and the fourth cavity portion C2 may be configured to prevent deterioration of antenna performance (a decrease in a compensation interference ratio between RF signals, distribution of RF signals in a y direction, degradation in degree of freedom in designing a resonance frequency, and the like), and the second depth D2 of the second cavity portion C3 and the fifth cavity portion C4 may be configured to optimize antenna performance.

Accordingly, antenna performance may further improve without an increase in overall size of the antenna apparatus.

The second cavity portion C3 and the fifth cavity portion C4 may be used for optimization of capacitance by the dipole antenna pattern 120*a* and the first, second, third, fifth, and sixth ground planes 221*a*, 222*a*, 223*a*, 225*a*, and 226*a*.

For example, an overlapping area between the dipole antenna pattern 120*a* and the first, second, third, fifth, and sixth ground planes 221*a*, 222*a*, 223*a*, 225*a*, and 226*a* in an x direction may correspond to an area of a plane in an equation for calculating capacitance, and the second depth D2 of the second cavity portion C3 and the fifth cavity portion C4 may correspond to a gap between planes in the equation for calculating capacitance.

Specific capacitance may be determined depending on the front width W2 and the rear width W1 of the step-type cavity CS.

Since the second depth D2 of the second cavity portion C3 and the fifth cavity portion C4 is less than a sum of the first and second depths (D1+D2) of the first cavity portion C1 and the fourth cavity portion C2, the capacitance formed by the dipole antenna pattern 120*a* and the first, second, third, fifth, and sixth ground planes 221*a*, 222*a*, 223*a*, 225*a*, and 226*a* may be increased by the second cavity portion C3 and the fifth cavity portion C4.

Also, a second length D2 of both side boundary lines in the front of the step-type cavity CS may be less than a first length D1 of both side boundary lines in the rear of the step-type cavity CS. Accordingly, capacitance formed by the dipole antenna pattern 120*a* and the first, second, third, fifth, and sixth ground planes 221*a*, 222*a*, 223*a*, 225*a*, and 226*a* may be further increased.

The dipole antenna pattern 120*a* may have a structure in which first and second dipole antenna patterns 121*a* and 122*a* are combined with a radial via 124*a*. Accordingly, capacitance formed by the dipole antenna pattern 120*a* and the first, second, third, fifth, and sixth ground planes 221*a*, 222*a*, 223*a*, 225*a*, and 226*a* may be further increased.

Thus, one of resonance frequencies of the dipole antenna pattern 120*a* may decrease. When the resonance frequency is a minimum frequency of a pass bandwidth of an RF signal, the pass bandwidth may expand as the resonance frequency moves. Thus, the antenna apparatus in the example embodiment may have a broadened pass bandwidth without an increase in overall size of the antenna apparatus.

Boundaries of the first, second, third, fifth, and sixth ground planes 221*a*, 222*a*, 223*a*, 225*a*, and 226*a* may form corners of the first cavity portion C1 with respect to an −x direction and a −y direction, and corners of the fourth cavity portion C2 with respect to a −x direction and a +y direction, and may also form corners of the second cavity portion C3 with respect to a −x direction and a −y direction, and corners of the fifth cavity portion C4 with respect to a −x direction and a +y direction.

Since the boundaries of the first, second, third, fifth, and sixth ground planes 221*a*, 222*a*, 223*a*, 225*a*, and 226*a* function as reflectors, the corners on the boundaries may affect the degree of concentration of RF signals formed in an x direction, and the degree of reflection of RF signals from the reflectors.

Thus, the degree of concentration may vary depending on a degree formed in an x direction by a point of the dipole antenna pattern 120*a* (e.g., a point between the dipole antenna pattern and the feed line) at which RF signals are concentrated and penetrate, and an imaginary line connecting the corners on the boundaries.

As the second depth D2 of the second cavity portion C3 and the fifth cavity portion C4 is shorter than a sum of the first and second depths (D1+D2) of the first cavity portion C1 and the fourth cavity portion C2, the number of corners provided by the boundaries of the first, second, third, fifth, and sixth ground planes 221*a*, 222*a*, 223*a*, 225*a*, and 226*a* may increase, and portions of the provided corners may be disposed more adjacent to the dipole antenna pattern 120*a*.

Thus, the RF signals reflected from the reflectors may be more concentrated in an x direction. Thus, the antenna apparatus 100*a* may have a greater gain without increasing an overall size of the antenna apparatus.

Also, a degree formed in an x direction by corners of the second cavity portion C3 and the fifth cavity portion C4, and an imaginary line connecting end portions of the dipole antenna pattern 120*a* in a y direction may affect the degree of concentration of the RF signals reflected from the reflectors in an x direction.

Thus, a degree formed in an x direction by corners of the second cavity portion C3 and the fifth cavity portion C4, and an imaginary line connecting end portions of the dipole antenna pattern 120*a* in a y direction may become closer to a degree formed in an x direction by a point of the dipole antenna pattern 120*a* (e.g., a point between the dipole antenna pattern and the feed line) at which RF signals are concentrated and penetrate, and an imaginary line connecting the corners on the boundaries.

Thus, overall degrees between the corners provided by the boundaries of the first, second, third, fifth, and sixth ground planes 221*a*, 222*a*, 223*a*, 225*a*, and 226*a*, and each portion of the dipole antenna pattern 120*a* may be balanced. Accordingly, the antenna apparatus may have a greater gain by concentrating RF signals in an x direction.

The antenna apparatus 100*a* may include at least portions of the feed line 110*a*, the feed via 111*a*, the dipole antenna pattern 120*a*, the director pattern 125*a*, and the connection member 200*a*.

The feed line 110*a* may be electrically connected to a wiring line in the fifth ground plane 225*a*, and the feed line 110*a* may function as a transfer pathway for RF signals. The feed line 110*a* may be considered to be a component included in the fifth ground plane 225*a*. As the dipole antenna pattern 120*a* is disposed adjacent to side surfaces of the connection member 200*a*, the feed line 110*a* may be configured to extend towards the dipole antenna pattern 120*a* from the wiring line of the fifth ground plane 225*a*.

The feed line 110*a* may be disposed between the first protrusion region P4 of the first, second, third, fifth, and sixth ground planes 221*a*, 222*a*, 223*a*, 225*a*, and 226*a* and the fourth ground plane 224*a*. Accordingly, the feed line 110*a* may decrease electromagnetic noise received from at least one of the dipole antenna pattern 120*a*, an adjacent antenna apparatus, and the patch antenna pattern. The greater the width and length of the first protrusion region P4, the more the electromagnetic noise of the feed line 110*a* may decrease.

The feed line 110*a* may include first and second feed lines. For example, the first feed line may be configured to transfer RF signals to the dipole antenna pattern 120*a*, and the second feed line may be configured to receive RF signals from the dipole antenna pattern 120*a*. For instance, the first feed line may be configured to receive RF signals from the dipole antenna pattern 120*a* or may be configured to transfer RF signals to the dipole antenna pattern 120*a*, and the second feed line may be configured to provide impedance to the dipole antenna pattern 120*a*.

For example, the first and second feed lines transferring RF signals to the dipole antenna pattern 120*a* and receiving RF signals to the dipole antenna pattern 120*a* may be configured through a differential feeding method to have a phase difference between the first and second feed line (e.g., 180 degrees, 90 degrees). The phase difference may be implemented by a phase shifter of an IC or by a difference between electrical lengths of the first and second feed lines.

In example embodiments, the feed line 110*a* may include a ¼ wavelength converter, a balun, or an impedance converting line to improve an RF signal transmission efficiency. A ¼ wavelength converter, a balun, or an impedance converting line may not be provided depending on design parameters.

The feed via 111*a* may be disposed to electrically connect the dipole antenna pattern 120*a* and the feed line 110*a*. The feed via 111*a* may be disposed perpendicular to the dipole antenna pattern 120*a* and the feed line 110*a*. When the dipole antenna pattern 120*a* and the feed line 110*a* are disposed at the same height, the feed via 111*a* may not be provided.

Due to the feed via 111*a*, the dipole antenna pattern 120*a* may be positioned lower or higher than the feed line 110*a*. The specific position of the dipole antenna pattern 120*a* may vary depending on a length of the feed via 111*a*, and thus, a direction of a radial pattern of the dipole antenna pattern 120*a* may be inclined in upward and downward directions (a z direction) depending on a design of a length of the feed via 111*a*.

For example, the dipole antenna pattern 120*a* may be positioned lower than the feed line 110*a* such that the dipole antenna pattern 120*a* may be spaced away from the fourth ground plane 224*a* by the feed via 111*a*. Accordingly, the fourth ground plane 224*a* may further improve electromagnetic isolation between the dipole antenna pattern 120*a* and the patch antenna pattern.

A via pattern 112*a* may be coupled to the feed via 111*a*, and may support an upper level and a lower level of the feed via 111*a*.

The dipole antenna pattern 120*a* may be electrically connected to the feed line 110*a* and may transmit or receive RF signals. Each pole of the dipole antenna pattern 120*a* may be electrically connected to first and second lines of the feed line 110*a*.

The dipole antenna pattern 120*a* may have a frequency band (e.g., 28 GHz, 39 GHz, 60 GHz) in accordance with at least one of a length of a pole, a thickness of a pole, a gap between poles, a gap between a pole and side surfaces of the connection member 200*a*, and a dielectric constant of an insulating layer.

The dipole antenna pattern 120*a* and the director pattern 125*a* may be considered to be components included in the third ground plane 223*a*. The director pattern 125*a* may not be provided depending on design parameters.

The director pattern 125*a* may be spaced apart from the dipole antenna pattern 120*a* in a lateral direction (e.g., an x direction). The director pattern 125*a* may be electromagnetically coupled to the dipole antenna pattern 120*a* and may improve a gain or a bandwidth of the dipole antenna pattern 120*a*. The director pattern 125*a* may have a length shorter than an overall length of a dipole of the dipole antenna pattern 120*a*, and thus, the degree of concentration of the electromagnetic coupling of the dipole antenna pattern 120*a* may be further improved. Thus, a gain or directivity of the dipole antenna pattern 120*a* may be further improved.

The number of the director patterns 125*a* may be less than the number of the dipole antenna patterns 120*a*. Thus, an overlapping area between the front region of the first dipole antenna pattern 121*a* and the director pattern 125*a* in upward and downward directions may be filled with an insulating layer. Accordingly, a direction of a radial pattern of the dipole antenna pattern 120*a* may further be inclined in upward and downward directions (a z direction) depending on a design of a length of the feed via 111*a*.

Referring to FIG. 1B, in an antenna apparatus 100*b*, a dipole antenna pattern 120*b* may have a folded dipole form, and a feed via, a director pattern, and the first protrusion region P4 of the antenna apparatus 100*a* may be omitted. For example, the antenna apparatus 100*b* may include a connection member 200*a*-1 including first, second, third, fourth, fifth, and sixth ground planes 221*a*-1, 222*a*-1, 223*a*-1, 224*a*-1, 225*a*-1, and 226*a*-1 in which the first protrusion region P4 of FIG. 1A is not formed.

Figure 3A:
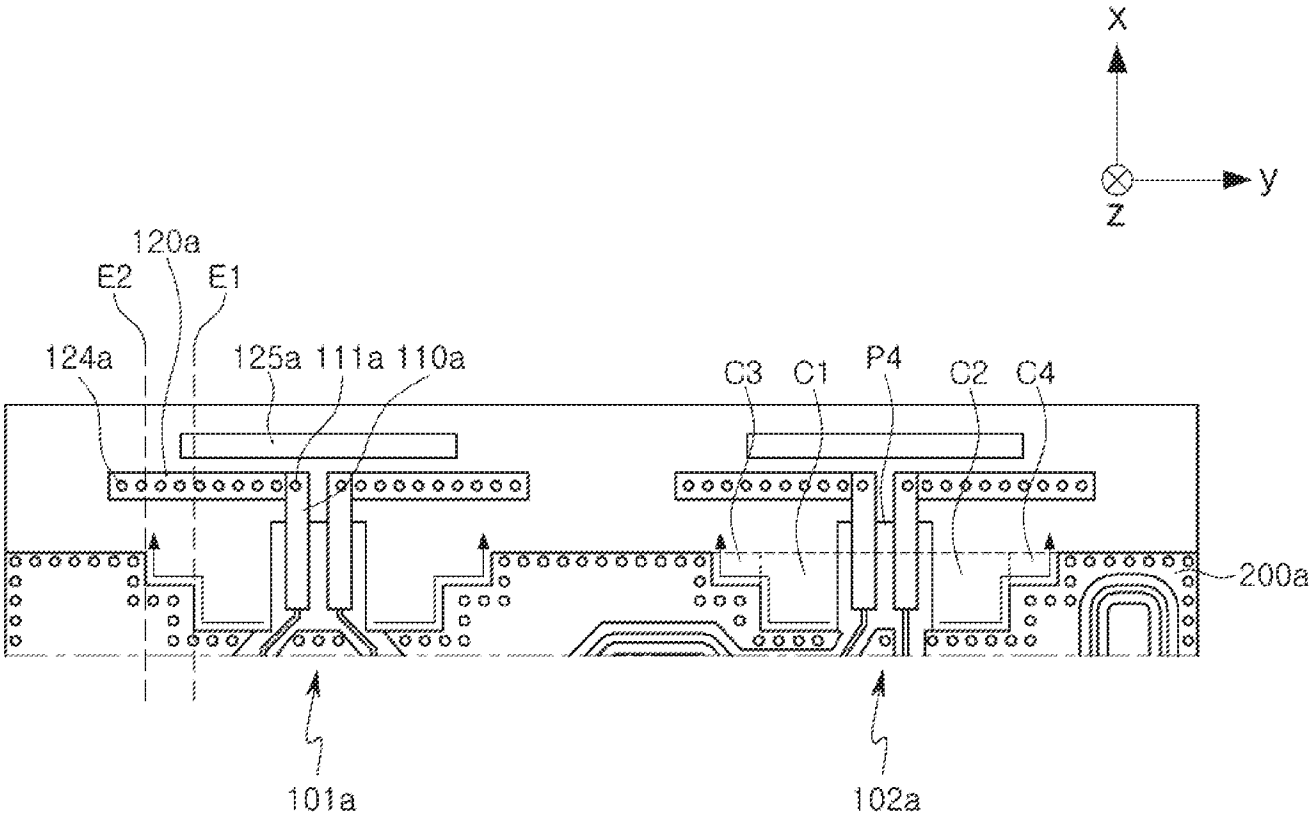
FIGS. 3A and 3B are plan diagrams illustrating antenna apparatuses, according to an embodiment.
Figure 3B:
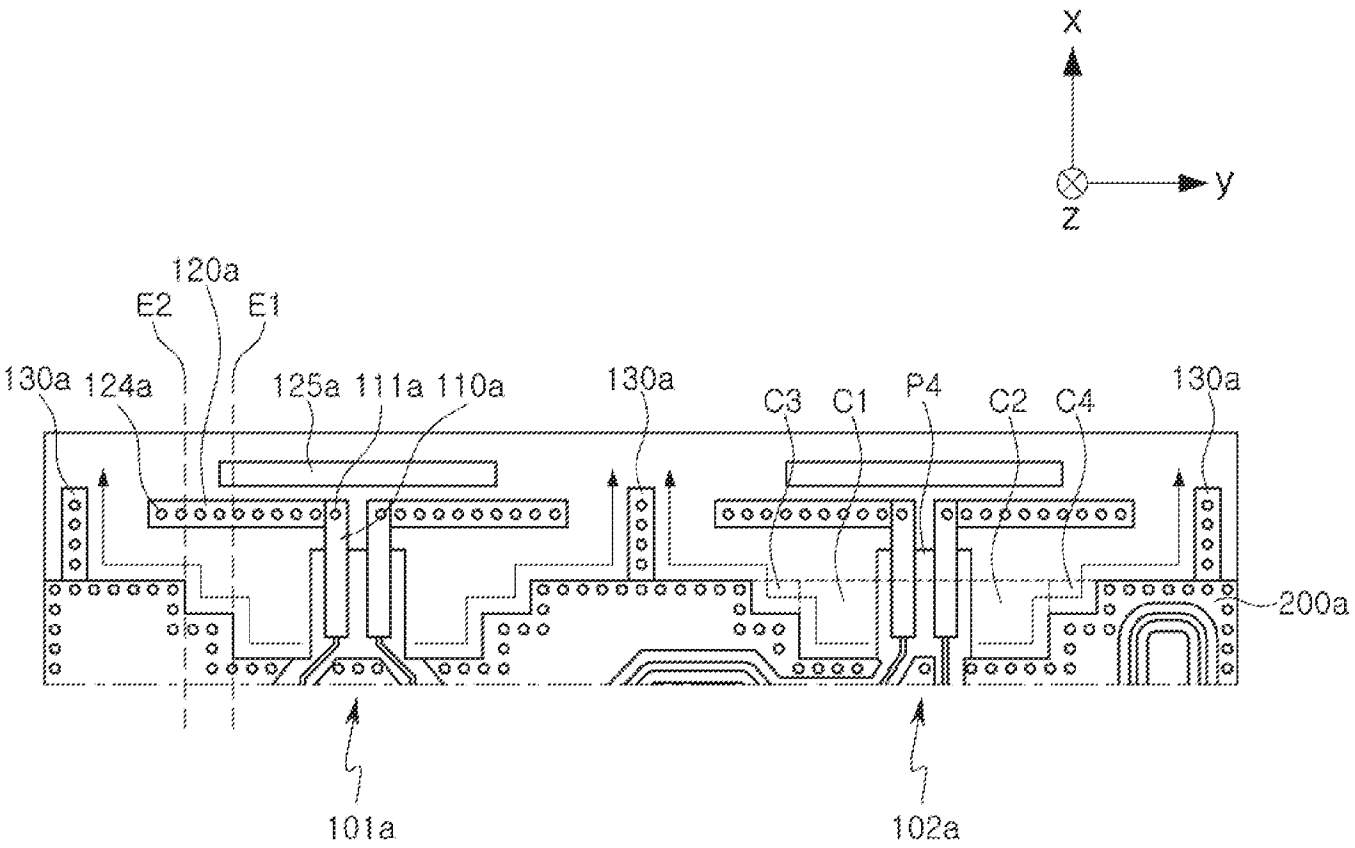

FIGS. 3A and 3B are plan diagrams illustrating antenna apparatuses 101*a* and 102*a*, according to an embodiment.

Referring to FIG. 3A, the antenna apparatuses 101*a* and 102*a* may be arranged in 1×n structure, where "n" is a natural number equal to or higher than 2.

An imaginary extended line E1 of both side boundary lines in the rear of a step-type cavity may be configured to intersect the dipole antenna pattern 120*a* and the director pattern 125*a*, and an extended line E2 of both side boundary lines in the front of the step-type cavity may be configured to intersect the dipole antenna pattern 120*a* and may be configured to not intersect the director pattern 125*a*.

Accordingly, the antenna apparatuses 101*a* and 102*a* may be optimized to have a relatively broad bandwidth.

Referring to FIG. 3B, the antenna apparatuses 101*a* and 102*a* may further include a blocking pattern 130*a* extending in an x direction from a portion of the connection member disposed outside of the step-type cavity in a y direction. Accordingly, the antenna apparatuses 101*a* and 102*a* may operate as if a size of the step-type cavity has increased without a substantial increase in size, and as if a ground plane has been recessed once more. Thus, a bandwidth and/or a gain based on sizes of the antenna apparatuses 101*a* and 102*a* may further improve.

For example, the blocking pattern 130*a* may extend to the front region further than a feed line 120*a*, and may be implemented as a plurality of layers. Accordingly, a bandwidth and/or a gain based on sizes of the antenna apparatuses 101*a* and 102*a* may be optimized.

Figure 4:
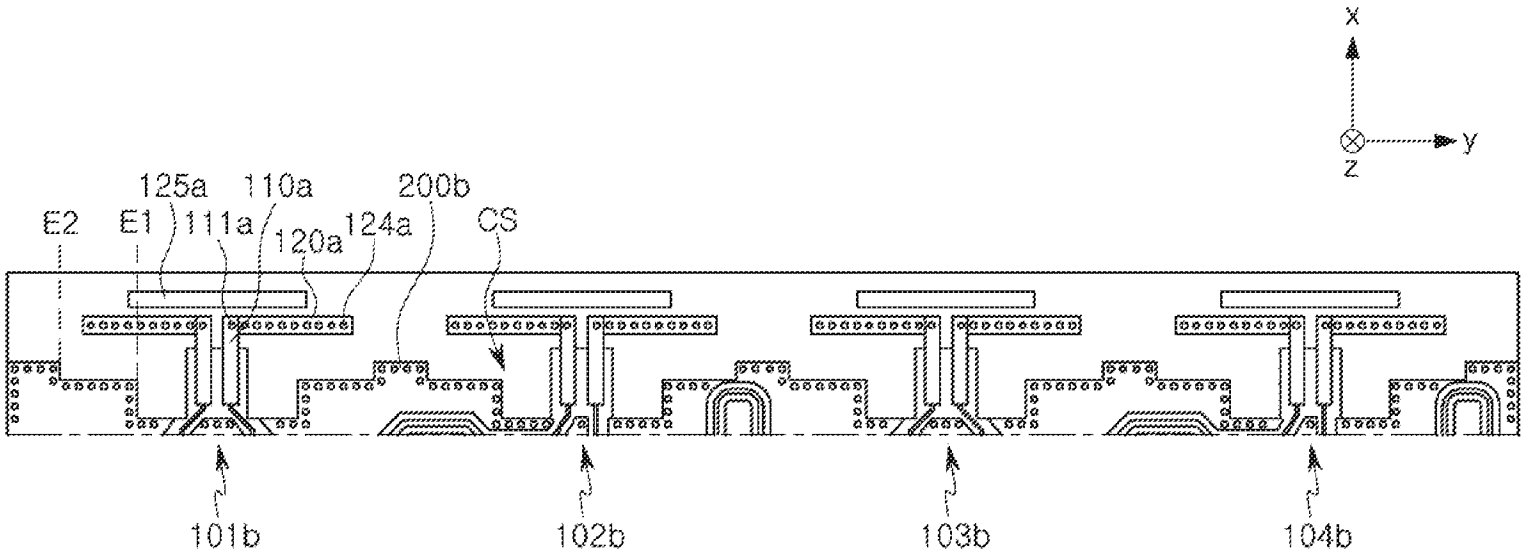
FIG. 4 is a plan diagram illustrating antenna apparatuses, according to an embodiment.

FIG. 4 is a plan diagram illustrating antenna apparatuses 101*b*, 102*b*, 103*b*, and 104*b*, according to an embodiment.

Referring to FIG. 4, a specific form of a step-type cavity CS of the antenna apparatuses 101*b*, 102*b*, 103*b*, and 104*b* may be different from the examples of cavities illustrated in FIGS. 3A and 3B.

For example, an extended line E2 of both side boundary lines in the front of the step-type cavity CS may not intersect the dipole antenna pattern 120*a*. Accordingly, both side portions in the front of the step-type cavity CS may function as the blocking pattern illustrated in FIG. 3B.

FIGS. 5A to 5E are plan diagrams illustrating the first to fifth ground planes 221*a*, 222*a*, 223*a*, 224*a*, 225*a*, and 226*a* of an antenna apparatus in order in a z direction, according an embodiment.

Figure 5A:
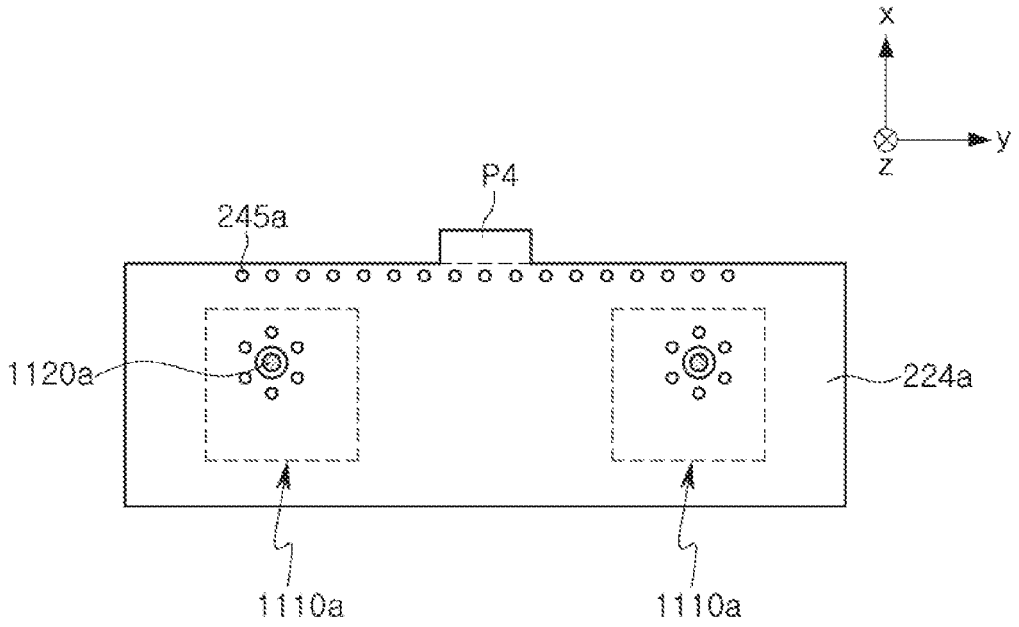
FIGS. 5A to 5E are plan diagrams illustrating first to fifth ground planes of an antenna apparatus, in order in a z direction, according to an embodiment.

Referring to FIG. 5A, the fourth ground plane 224*a* may be disposed in a lower level of patch antenna patterns 1110*a*. The fourth ground plane 224*a* may have through-holes through which second feed vias 1120*a* respectively penetrate, and may include the first protrusion region P4.

The patch antenna patterns 1110*a* may remotely transmit and/or receive RF signals in a z direction. Thus, the antenna apparatus may transmit and receive RF signals in a horizontal direction through a dipole antenna pattern, and may also transmit and receive RF signals in a vertical direction through the plurality of patch antenna patterns 1110*a*, thereby remotely transmitting and receiving RF signals in all directions.

Figure 5B:
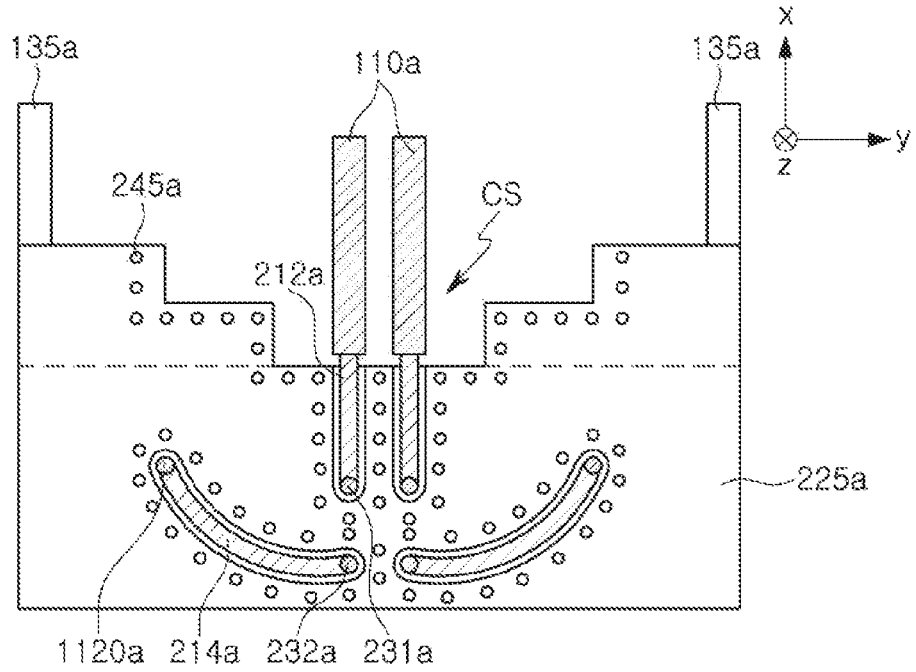

Referring to FIG. 5B, the fifth ground plane 225*a* may surround a first wiring line 212*a* electrically connecting a feed line 110*a* and a first wiring via 231*a*, and a second wiring line 214*a* electrically connecting a second feed via 1120*a* and a second wiring via 232*a*, and may be connected to a fifth blocking pattern 135*a*.

A plurality of shielding vias 245*a* may be arranged along front boundary lines of a step-type cavity CS, and may electrically connect the fifth ground plane 225*a* to the second ground plane 222*a*.

Figure 5C:
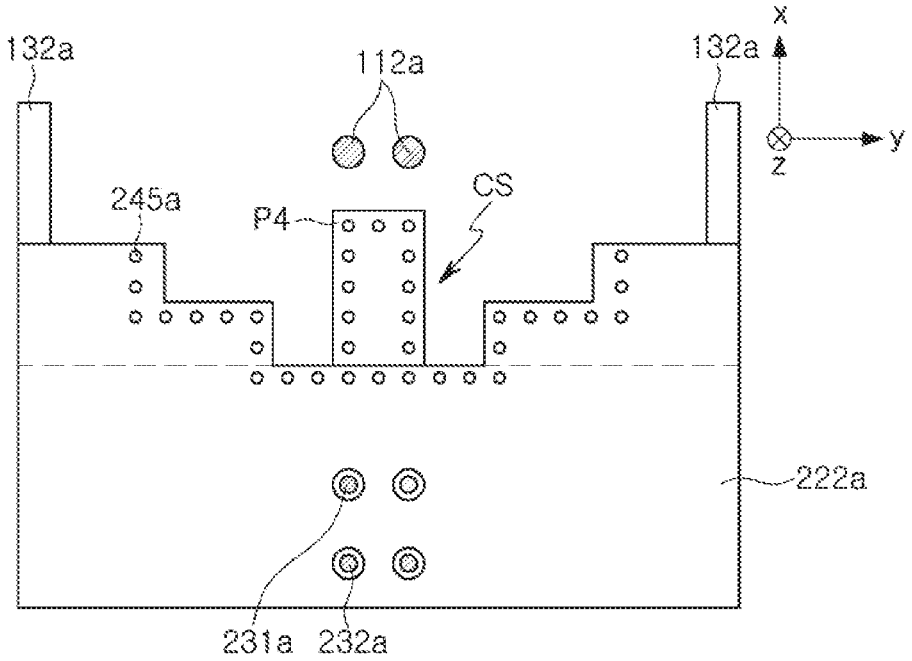

Referring to FIG. 5C, the second ground plane 222*a* may include a through-hole through which the first and second wiring vias 231*a* and 232*a* penetrate, and may be connected to a second blocking pattern 132*a*. The shielding vias 245*a* may be arranged along a front boundary line of the step-type cavity CS, and may electrically connect the second ground plane 222*a* and the first ground plane 221*a* to each other. The via pattern 112*a* may be electrically connected to a dipole antenna pattern.

Figure 5D:
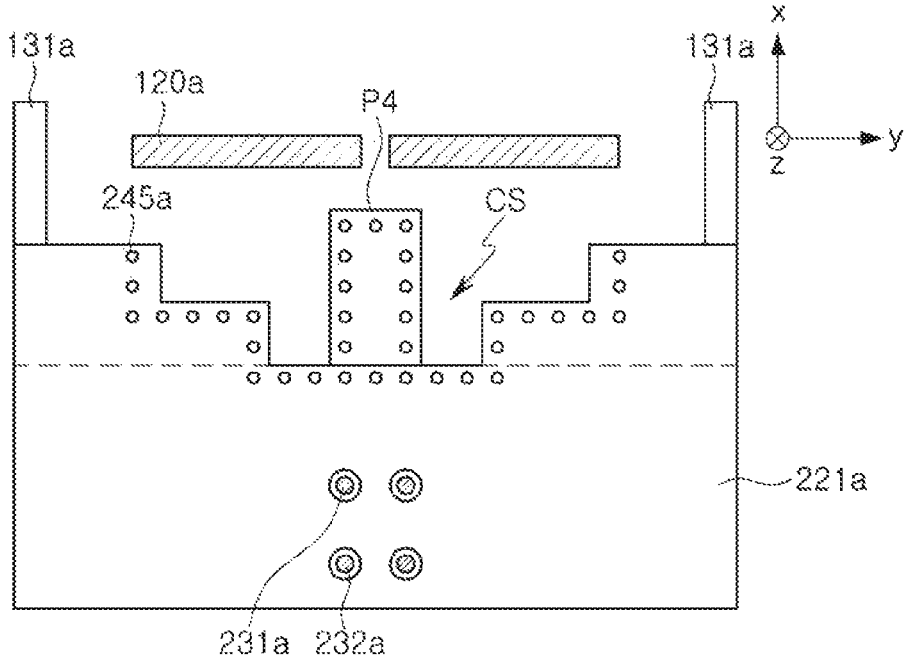

Referring to FIG. 5D, the first ground plane 221*a* may be configured to be recessed rearwardly of the dipole antenna pattern 120*a* twice, may include a through-hole through which first and second wiring vias 231*a* and 232*a* penetrate, and may be connected to a first blocking pattern 131*a*. Shielding vias 245*a* may be arranged along a front boundary line of the step-type cavity CS, and may electrically connect the first ground plane 221*a* and the third ground plane 223*a* to each other. The dipole antenna pattern 120*a* may be disposed in front of (e.g., in an x direction) the step-type cavity CS.

Figure 5E:
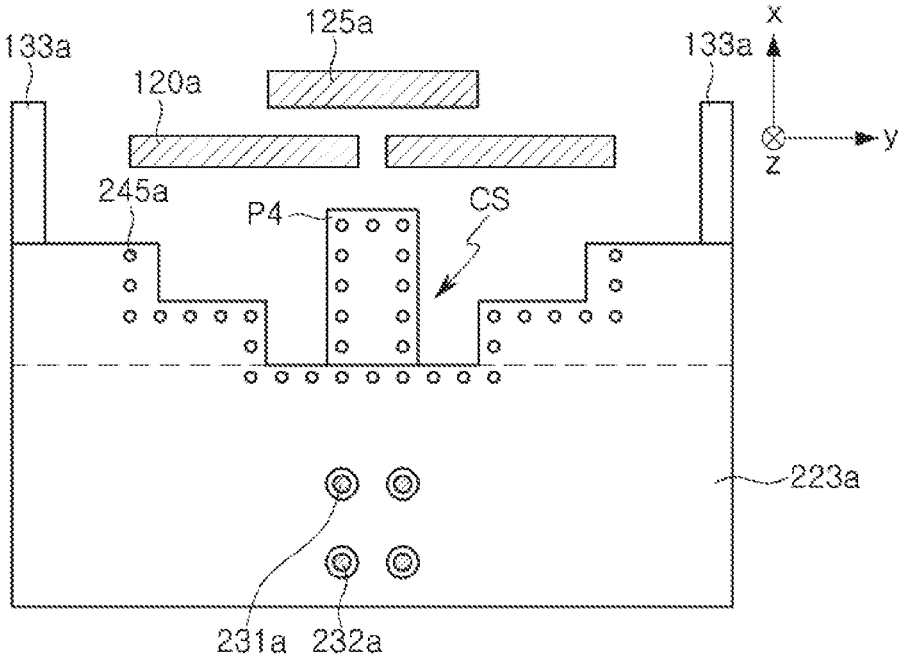

Referring to FIG. 5E, a third ground plane 223*a* may include a through-hole through which first and second wiring vias 231*a* and 232*a* penetrate, and may be connected to a third blocking pattern 133*a*. The dipole antenna pattern 120*a* and a director pattern 125*a* may be disposed in front of (e.g., in an x direction) the step-type cavity CS.

An overlapping area between the front region of the first ground plane 221*a* and the director pattern 125*a* in upward and downward directions (a z direction) may be filled with an insulating layer. Thus, the number of the layered director patterns 125*a* may be less than the number of the layered dipole antenna patterns 120*a*. Accordingly, a radial pattern of the dipole antenna pattern 120*a* may be more concentrated three-dimensionally, and a gain and/or directivity of the dipole antenna pattern 120*a* may be further improved.

Since the first, second, third, and fifth blocking patterns 131*a*, 132*a*, 133*a*, and 135*a* are disposed to overlap with one another in upward and downward directions (a z direction), a three-dimensional boundary condition may be provided in relation to the dipole antenna pattern 120*a*. Accordingly, the first, second, third, and fifth blocking patterns 131*a*, 132*a*, 133*a*, and 135*a* may effectively isolate the dipole antenna patterns 120*a* from each other, and may improve gains of the dipole antenna patterns 120*a*. Also, when the dipole antenna patterns 120*a* have a layering structure in a z direction, the first, second, third, and fifth blocking patterns 131*a*, 132*a*, 133*a*, and 135*a* may increase a size of an electromagnetic coupling surface in relation to the dipole antenna pattern 120*a*, and thus, a design range of a resonance frequency of the dipole antenna pattern 120*a* may be expanded, and a bandwidth may be broadened.

The shielding vias 245*a* may only be arranged on front boundary lines of the first to fifth ground planes 221*a*, 222*a*, 223*a*, 224*a*, and 225*a*, rather than being disposed among the first, second, third, and fifth blocking patterns 131*a*, 132*a*, 133*a*, and 135*a*. Thus, spaces between the first, second, third, and fifth blocking patterns 131*a*, 132*a*, 133*a*, and 135*a* may be filled with an insulating layer. Accordingly, the first, second, third, and fifth blocking patterns 131*a*, 132*a*, 133*a*, and 135*a* may provide a three-dimensional boundary condition in relation to the dipole antenna pattern 120*a*, and may effectively emit electromagnetic energy concentrated on the front boundary lines of the first to fifth ground planes 221*a*, 222*a*, 223*a*, 224*a*, and 225*a*, thereby improving electromagnetic isolation between the dipole antenna patterns 120*a*, and also improving electromagnetic isolation between the dipole antenna patterns 120*a* and the patch antenna patterns 1110*a*.

The greater the number of the ground planes forming the cavity among the first to fifth ground planes 221*a*, 222*a*, 223*a*, 224*a*, and 225*a*, the longer the length of the cavity is in upward and downward directions (a z direction). The length of the cavity in upward and downward directions (a z direction) may affect antenna performance of the dipole antenna pattern 120*a*. The antenna apparatus 100*a*/100*b* may easily adjust the length of the cavity in upward and downward directions (a z direction) by adjusting the number of the ground planes forming the cavity, and thus, antenna performance of the dipole antenna pattern 120*a* may easily be adjusted.

Recessed regions of at least two of the first to fifth ground planes 221*a*, 222*a*, 223*a*, 224*a*, and 225*a* may have the same rectangular shape. Accordingly, the cavity may have a rectangular parallelepiped shape. When the cavity has a rectangular parallelepiped shape, a ratio of an x vector component to a y vector component of an RF signal may increase. A y vector component may easily be offset in the cavity as compared to an x vector component, and thus, the higher the ratio of an x vector component of an RF signal reflected from a boundary of the cavity, the more improved gain the dipole antenna pattern 120*a* may have. Thus, the more similar to the parallelepiped on the cavity is, the more improved gain the dipole antenna pattern 120*a* may have.

Figure 6:
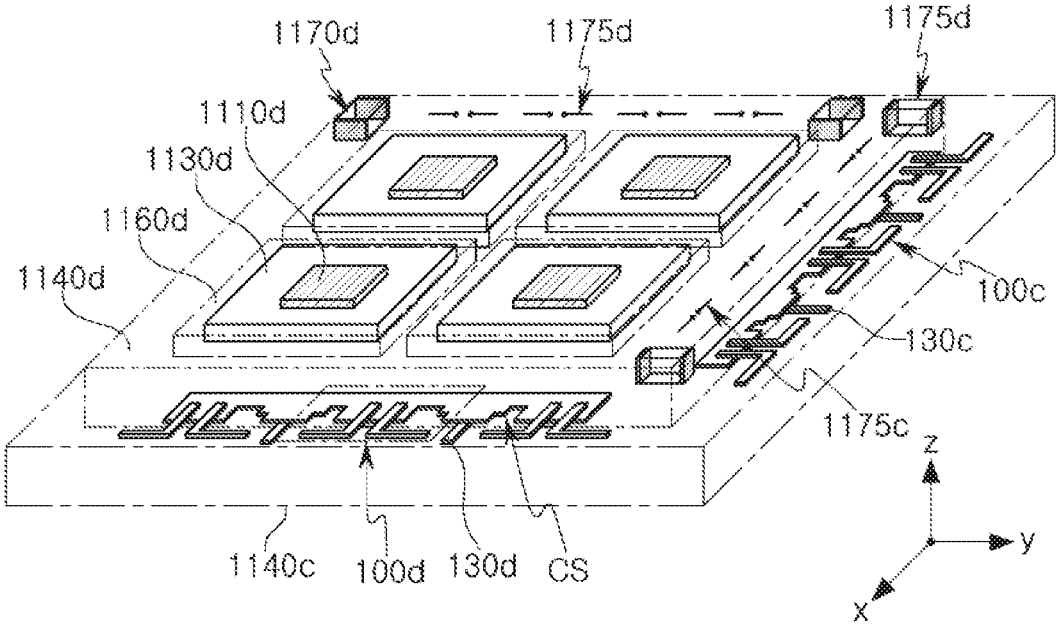
FIG. 6 is a perspective diagram illustrating an arrangement of antenna apparatuses illustrated in FIGS. 1A to 5E, according to an embodiment.

FIG. 6 is a perspective diagram illustrating an arrangement of antenna apparatuses illustrated in FIGS. 1A to 5E, according to an embodiment.

Referring to FIG. 6, an antenna apparatus may include antenna apparatuses 100*c* and 100*d*, patch antenna patterns 1110*d*, patch antenna cavities 1130*d*, dielectric layers 1140*c* and 1140*d*, a plating member 1160*d*, chip antennas 1170*c* and 1170*d*, and dipole antennas 1175*c* and 1175*d*.

The antenna apparatuses 100*c* and 100*d* may be designed similarly to the antenna apparatus described with reference to FIGS. 1A to 5E, and may be disposed adjacent to side surfaces of an antenna module and may be arranged in parallel to each other. Accordingly, a portion of the antenna apparatuses 100*c* and 100*d* may transmit and receive RF signals in an x axis direction, and another portion of the antenna apparatuses 100*c* and 100*d* may transmit and receive RF signals in a y axis direction.

The patch antenna patterns 1110*d* may be disposed adjacent to an upper level of the antenna module, and may transmit and receive RF signals in upward and downward directions (a z direction). The number and an arrangement of the patch antenna patterns 1110*d* may not be limited to any particular number and an arrangement. For example, the patch antenna patterns 1110*d* may have a circular form, and may be arranged in a structure of 1×n (n is a natural number equal to or greater than 2), and the number of the patch antenna patterns may be 16.

The patch antenna cavities 1130*d* may be configured to cover side surfaces and a lower level of each of the patch antenna patterns 1110*d*, and may provide a boundary condition for each of the patch antenna patterns 1110*d* to transmit and receive RF signals.

The chip antennas 1170*c* and 1170*d* may have two electrodes opposing each other, may be disposed in an upper level or a lower level of an antenna module, and may be disposed to transmit and receive RF signals in an x axis direction and/or a y axis direction through one of the two electrodes.

The dipole antennas 1175*c* and 1175*d* may be disposed in an upper level or in a lower level of the antenna module, and may transmit and receive RF signals in a z axis direction. Thus, the antennas 1175*c* and 1175*d* may be disposed perpendicular to the plurality of antenna apparatuses 100*c* and 100*d* in upward and downward directions (a z direction).

Figure 7A:
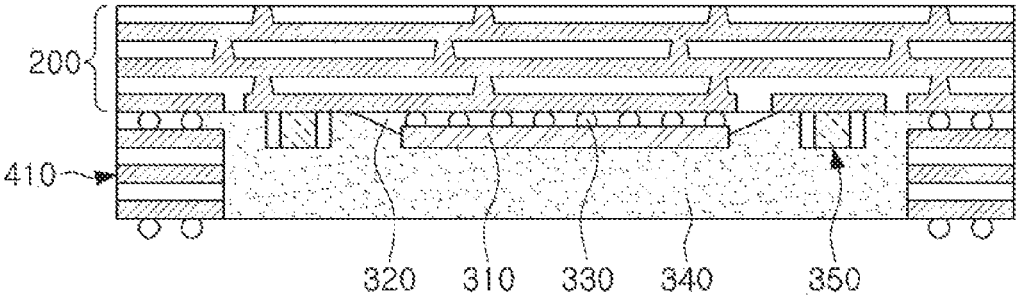
FIGS. 7A and 7B are diagrams illustrating a structure of a lower level of a connection member which may be included in antenna apparatuses illustrated in FIGS. 1A to 5E, according to an embodiment.
Figure 7B:
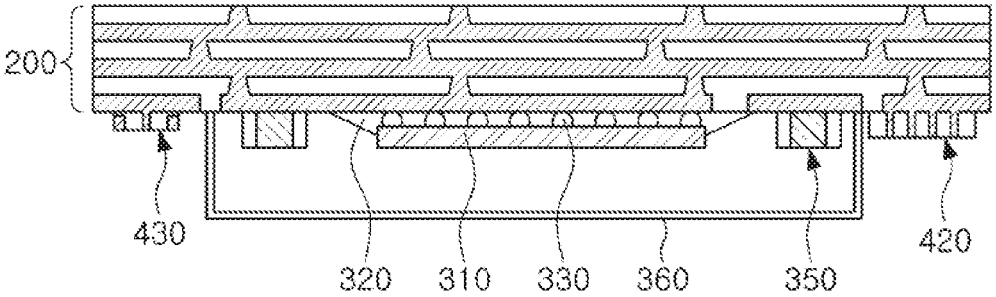

FIGS. 7A and 7B are diagrams illustrating a structure of a lower level of a connection member 200, which may be included in antenna apparatuses illustrated in FIGS. 1A to 5E.

Referring to FIG. 7A, an antenna apparatus in the example embodiment may include at least portions of the connection member 200, an IC 310, an adhesive member 320, an electrical connection structure 330, an encapsulant 340, a passive component 350, and a sub-substrate 410.

The connection member 200 may have a structure similar to a structure of a connection member described with reference to FIGS. 1 to 8.

The IC 310 may be the same as the IC described in the aforementioned embodiment, and may be disposed in a lower level of the connection member 200. The IC 310 may be electrically connected to a wiring line of the connection member 200 and may transmit or receive RF signals, and may be electrically connected to a ground plane of the connection member 200 and may be provided with a ground. For example, the IC 310 may perform at least portions of operations among a frequency conversion, an amplification, a filtering, a phase control, and a power generation, thereby generating a converted signal.

The adhesive member 320 may bond the IC 310 to the connection member 200.

The electrical connection structure 330 may electrically connect the IC 310 to the connection member 200. For example, the electrical connection structure 330 may include a structure such as a solder ball, a pin, a land, or a pad. The electrical connection structure 330 may have a melting point lower than melting points of a wiring line of the connection member 200 and the ground plane, and may electrically connect the IC 310 to the connection member 200 through a certain process using a low melting point.

The encapsulant 340 may encapsulate at least a portion of the IC 310, and may improve heat radiation performance and shock protection performance. For example, the encapsulant 340 may be a photo-imagable encapsulant (PIE), an Ajinomoto build-up film (ABF), an epoxy molding compound (EMC), or the like.

The passive component 350 may be disposed on a lower surface of the connection member 200, and may be electrically connected to a wiring line and/or a ground plane of the connection member 200 through the electrical connection structure 330.

The sub-substrate 410 may be disposed in a lower level of the connection member 200, and may be electrically connected to the connection member 200 to receive an intermediate frequency (IF) signal or a base band signal from an external entity and may transfer the signal to the IC 310, or to receive an IF signal or a base band signal from the IC 310 and transfer the signal to an external entity. A frequency of an RF signal (e.g., 24 GHz, 28 GHz, 36 GHz, 39 GHz, and 60 GHz) may be greater than a frequency of an IF signal (e.g., 2 GHz, 5 GHz, 10 GHz, and the like).

For example, the sub-substrate 410 may transfer an IF signal or a base band signal to the IC 310 or may receive an IF signal or a base band signal from the IC 310 via a wiring line included in an IC ground plane of the connection member 200. Since a first ground plane of the connection member 200 is disposed between the IC ground plane and the wiring line, an IF signal or a base band signal and an RF signal may be electrically isolated from each other in an antenna module.

Referring to FIG. 7B, an antenna apparatus in the example embodiment may include at least portions of a shielding member 360, a connector 420, and a chip antenna 430.

The shielding member 360 may be disposed in a lower level of the connection member 200 and may shield the IC 310 together with the connection member 200. For example, the shielding member 360 may cover or conformally shield the IC 310 and the passive component 350 together, or may cover or shield the IC 310 and the passive component 350 individually in compartment form. For example, the shielding member 360 may have a hexahedral shape in which one surface is opened, and may have a hexahedral receiving space by being coupled to the connection member 200. The shielding member 360 may be implemented by a material having high conductivity such as copper and may have a relatively short skin depth, and may be electrically connected to a ground plane of the connection member 200. Thus, the shielding member 360 may reduce electromagnetic noise which the IC 310 and the passive component 350 may receive.

The connector 420 may have a connection structure of a cable (e.g., a coaxial cable, a flexible PCB, and the like), may be electrically connected to an IC ground plane of the connection member 200, and may work similarly to the sub-substrate described in the aforementioned example embodiment. Thus, the connector 420 may receive an IF signal, a base band signal and/or power from a cable, or may provide an IF signal and/or a base band signal to a cable.

The chip antenna 430 may transmit or receive an RF signal as an auxiliary element of the antenna apparatus in the example embodiment. For example, the chip antenna 430 may include a dielectric block having a dielectric constant greater than a dielectric constant of an insulating layer, and electrodes disposed on both surfaces of the dielectric block. One of the electrodes may be electrically connected to a wiring line of the connection member 200, and another of the electrodes may be electrically connected to a ground plane of the connection member 200.

Figure 8:
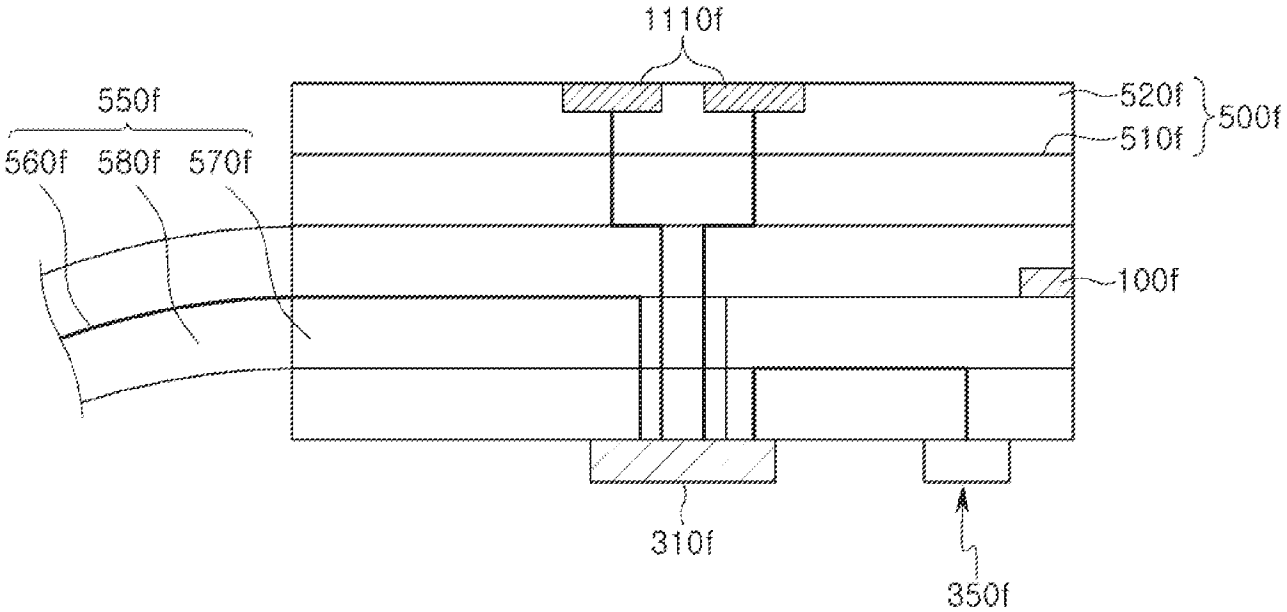
FIG. 8 is a lateral view of a rigid flexible structure implementable in antenna apparatuses illustrated in FIGS. 1A to 5E, according to an embodiment.

FIG. 8 is a lateral view of a rigid flexible structure implementable in antenna apparatuses illustrated in FIGS. 1A to 5E.

Referring to FIG. 8, an antenna apparatus 100*f* may have a structure in which a patch antenna pattern 1110*f*, an IC 310*f*, and a passive component 350*f* are integrated into a connection member 500*f*.

The antenna apparatus 100*f* and the patch antenna pattern 1110*f* may configured to be the same as the antenna apparatus and the patch antenna pattern described in the aforementioned example embodiment, and may receive an RF signal from the IC 310 and transmit the received signal, or may transmit a received RF signal to the IC 310.

The connection member 500*f* may have a structure (e.g., a structure of a printed circuit board) in which at least one conductive layer 510*f* and at least one insulating layer 520*f* are layered. The conductive layer 510*f* may have the ground plane and the wiring line described in the aforementioned example embodiment.

The antenna apparatus 100*f* may further include a flexible connection member 550*f*. The flexible connection member 550*f* may include a first flexible region 570*f* overlapping the connection member 500*f*, and a second flexible region 580*f* which does not overlap the connection member 500*f*, in upward and downward directions.

The second flexible region 580*f* may be flexibly bent in upward and downward directions. Accordingly, the second flexible region 580*f* may be flexibly connected to a connector on a set substrate and/or an adjacent antenna module.

The flexible connection member 550*f* may include a signal line 560*f*. An intermediate frequency (IF) signal and/or a base band signal may be transferred to the IC 310*f* via the signal line 560*f*, or may be transferred to a connector on a set substrate and/or an adjacent antenna module.

Figure 9A:
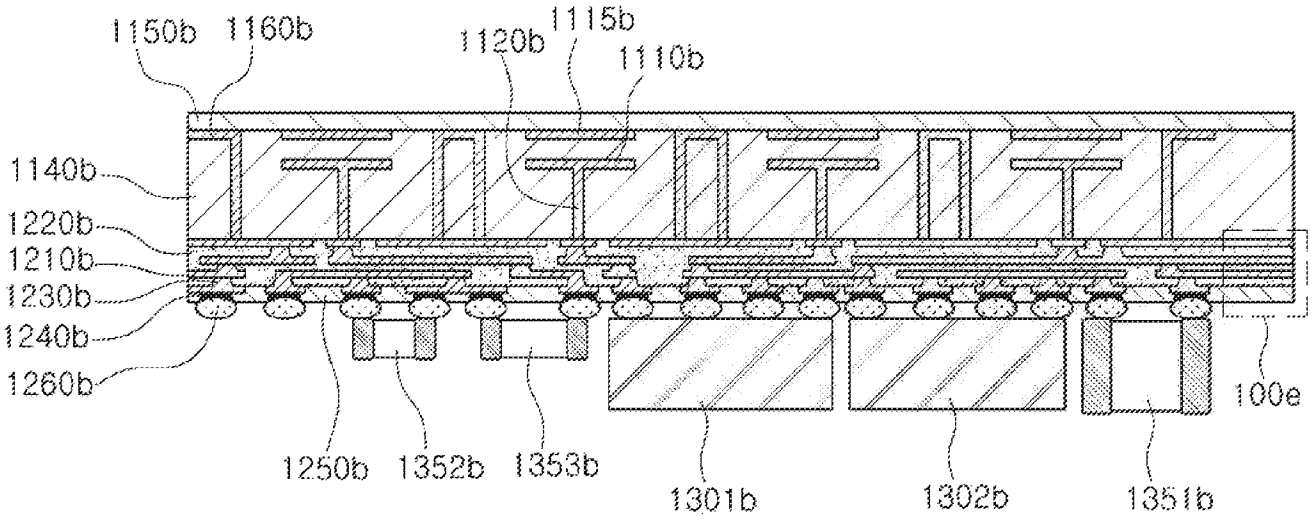
FIGS. 9A and 9B are lateral views of an antenna package and an IC package, which may be included in antenna apparatuses illustrated in FIGS. 1A to 5E, according to an embodiment.
Figure 9B:
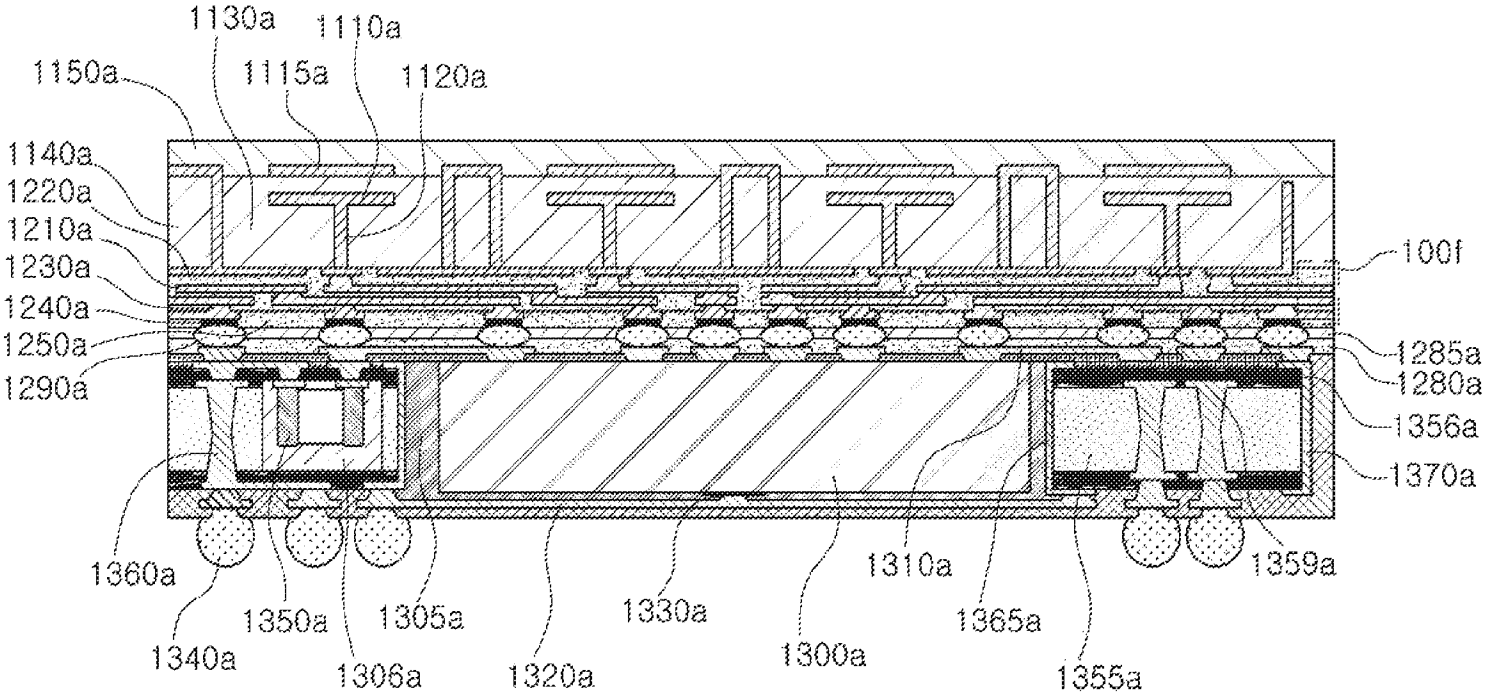

FIGS. 9A and 9B are lateral views of an example of an antenna package and an example of an IC package which may be included in antenna apparatuses illustrated in FIGS. 1A to 5E.

Referring to FIG. 9A, an antenna apparatus in the example embodiment may have a structure in which an antenna package and a connection member are coupled to each other.

The connection member may include at least one conductive layer 1210*b*, and at least one insulating layer 1220*b*, and may further include a wiring via 1230*b* connected to the at least one conductive layer 1210*b*, and a connection pad 1240*b* connected to the wiring via 1230*b*. The connection member may have a structure similar to a structure of a copper redistribution layer (RDL). An antenna package may be disposed on an upper surface of the connection member.

The antenna package may include at least portions of a plurality of patch antenna patterns 1110*b*, a plurality of upper coupling patterns 1115*b*, a plurality of second feed vias 1120*b*, a dielectric layer 1140*b*, and an encapsulation member 1150*b*.

First ends of the second feed vias 1120*b* may be electrically connected to the antenna patterns 1110*b*, and second ends of the second feed vias 1120*b* may be electrically connected to wiring lines corresponding to at least one conductive layer 1210*b* of the connection member, respectively.

The dielectric layer 1140*b* may be disposed to surround side surfaces of each of the feed vias 1120*b*. The dielectric layer 1140*b* may have a height higher than a height of at least one of insulating layers 1220*b* of the connection member.

The greater the height and/or width of the dielectric layer 1140*b*, the more likely the antenna package may provide antenna performance, and boundary conditions (e.g., a reduced manufacturing tolerance, a shorter electrical length, a smooth surface, an increased size of a dielectric layer, adjustment of a dielectric constant, and the like) for transmission and reception of RF signals dipole antenna patterns 1115*b* may be provided.

The encapsulation member 1150*b* may be disposed on the dielectric layer 1140*b*, and may improve durability of the patch antenna patterns 1110*b* and/or the upper coupling patterns 1115*b* against shocks or oxidation. For example, the encapsulation member 1150*b* may be a photo-imagable encapsulant (PIE), an Ajinomoto build-up film (ABF), an epoxy molding compound (EMC), or the like, but the encapsulation member 1150*b* is not limited to these examples.

An IC 1301*b*, a PMIC 1302*b*, and passive components 1351*b*, 1352*b*, and 1353*b* may be disposed on a lower surface of the connection member.

The PMIC 1302*b* may generate power, and may transfer the generated power to the IC 1301*b* through at least one conductive layer 1210*b* of the connection member.

The passive components 1351*b*, 1352*b*, and 1353*b* may provide impedance to the IC 1301*b* and/or the PMIC 1302*b*. For example, the passive components 1351*b*, 1352*b*, and 1353*b* may include at least portions of a capacitor (e.g., a multilayer ceramic capacitor (MLCC)), and inductor, or a chip resistor.

Referring to FIG. 9B, an IC package may include an IC 1300*a*, an encapsulant 1305*a* encapsulating at least a portion of the IC 1300*a*, a support member 1355*a* of which a first side surface may be configured to oppose the IC 1300*a*, at least one conductive layer 1310*a* electrically connected to the IC 1300*a* and the support member 1355*a*, and a connection member including an insulting layer 1280*a*, and may be coupled to the connection member or an antenna package.

The connection member may include at least one conductive layer 1210*a*, at least one insulating layer 1220*a*, a wiring via 1230*a*, a connection pad 1240*a*, and a passivation layer 1250*a*. The antenna package may include patch antenna patterns 1110*a*, upper coupling patterns 1115*a*, second feed vias 1120*a*, a dielectric layer 1140*a*, and an encapsulation member 1150*a*.

The IC package may be coupled to the connection member. An RF signal generated in the IC 1300*a* included in the IC package may be transferred to the antenna package through at least one conductive layer 1310*a* and may be transmitted towards an upper surface of the antenna module, and the RF signal received in the antenna package may be transferred to the IC 1300*a* through at least one conductive layer 1310*a*.

The IC package may further include a connection pad 1330*a* disposed on an upper surface and/or a lower surface of the IC 1300*a*. The connection pad disposed on the upper surface of the IC 1300*a* may be electrically connected to at least one conductive layer 1310*a*, and the connection pad disposed on a lower surface of the IC 1300*a* may be electrically connected to a support member 1355*a* or a core plating member 1365*a* through a lower conductive layer 1320*a*. The core plating member 1365*a* may provide a ground region to the IC 1300*a*.

The support member 1355*a* may include a core dielectric layer 1356*a* that is in contact with the connection member, a core conductive layer 1359*a* disposed on an upper surface and/or a lower surface of the core dielectric layer 1356*a*, and at least one core via 1360*a* penetrating the core dielectric layer 1356*a*, electrically connecting the core conductive layers 1359*a*, and electrically connected to the connection pad 1330*a*. The at least one core via 1360*a* may be electrically connected to an electrical connection structure 1340*a* such as a solder ball, a pin, and a land.

Accordingly, the support member 1355*a* may be supplied with a base signal or power from a lower surface and may transfer the base signal and/or power to the IC 1300*a* through at least one conductive layer 1310*a* of the connection member.

The IC 1300*a* may generate an RF signal of a mmWave band using the base signal and/or power. For example, the IC 1300*a* may receive the base signal of a low frequency, and may perform conversion and amplification of a frequency of the base signal, a filtering phase control, and power generation, and may be implemented as a compound semiconductor (e.g., GaAs) or may be implemented as a silicon semiconductor in consideration of frequency properties.

The IC package may further include a passive component 1350*a* electrically connected to a wiring line corresponding to at least one conductive layer 1310*a*. The passive component 1350*a* may be disposed in a receiving space 1306*a* provided by the support member 1355*a*.

The IC package may include core plating members 1365*a* and 1370*a* disposed on side surfaces of the support member 1355*a*. The core plating members 1365*a* and 1370*a* may provide a ground region to the IC 1300*a*, and may radiate heat of the IC 1300*a* to the outside or may remove noise of the IC 1300*a*.

The IC package and the connection member may be manufactured independently and coupled to each other, but may also be manufactured together depending on a design. A process of coupling a plurality of packages may be omitted.

The IC package may be coupled to the connection member through an electrical connection structure 1290*a* and a passivation layer 1285*a*, but the electrical connection structure 1290*a* and the passivation layer 1285*a* may be omitted depending on a design.

Figure 10A:
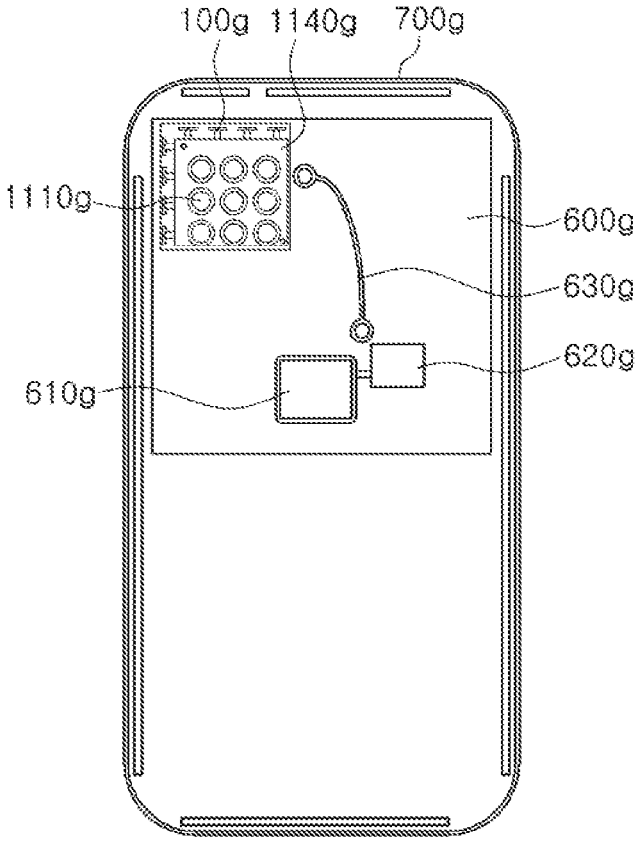
FIGS. 10A to 10C are plan diagrams illustrating an arrangement of antenna apparatuses in an electronic device, according to an embodiment.
Figure 10B:
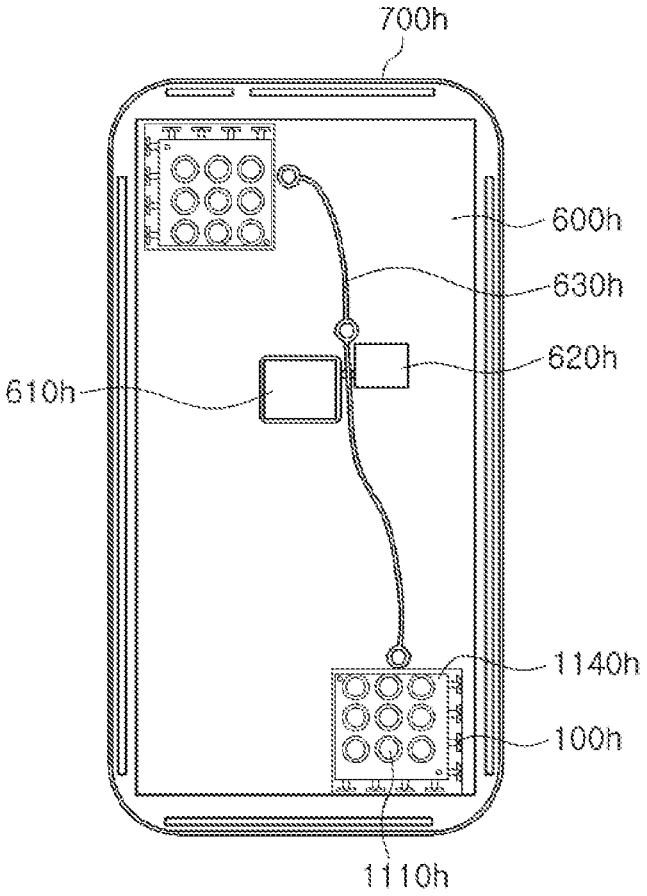
Figure 10C:
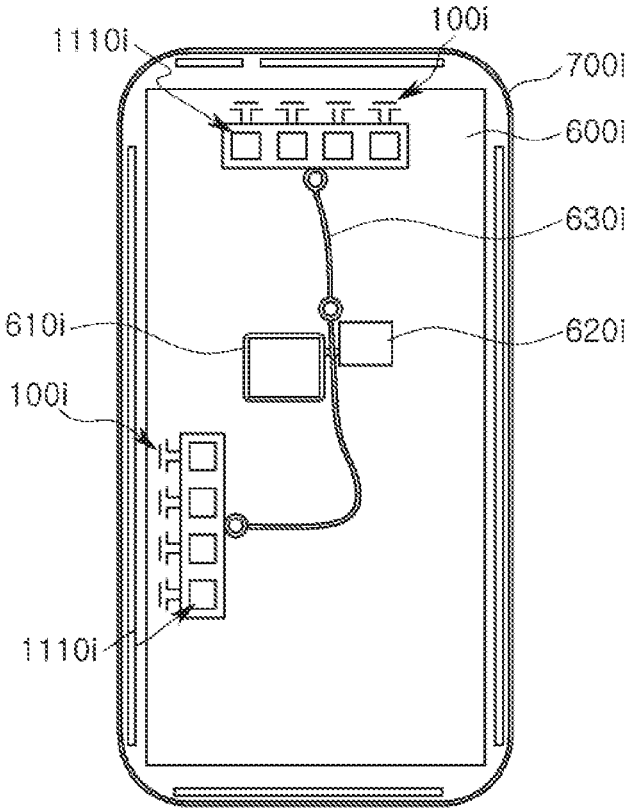

FIGS. 10A to 10C are plan diagrams illustrating an arrangement of antenna apparatuses in an electronic device, according to an embodiment.

Referring to FIG. 10A, an antenna module including an antenna apparatus 100*g*, a patch antenna pattern 1110*g*, and a dielectric layer 1140*g* may be disposed adjacent to a side boundary of an electronic device 700*g* on a set substrate 600*g* of the electronic device 700*g*.

The electronic device 700*g* may be a smart phone, a personal digital assistant, a digital video camera, a digital still camera, a network system, a computer, a monitor, a tablet, a laptop, a netbook, a television, a video game, a smart watch, an automotive device, and the like, but the disclosure is not limited thereto.

A communication module 610*g* and a baseband circuit 620*g* may further be disposed on the set substrate 600*g*. The antenna module may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., an ROM), a flask memory, and the like; an application processor chip such as a central processor (e.g., a CPU), a graphic process (e.g., a GPU), a digital signal processor, a crypto processor, a microprocessor, a micro controller, and the like, a logic chip such as an analog-to-digital converter, an application-specific IC (ASIC), and the like.

The baseband circuit 620*g* may generate a base signal by performing an analogue to digital conversion, an amplification of an analog signal, a filtering, and a frequency conversion. A base signal input to and output from the baseband circuit 620*g* may be transferred to the antenna module through via a cable.

For example, the base signal may be transferred to an IC via an electrical connection structure, a core via, and a wiring line. The IC may convert the base signal into an RF signal of an mmWave band.

Referring to FIG. 10B, a plurality of antenna modules each including an antenna apparatus 100*h*, a patch antenna pattern 1110*h*, and a dielectric layer 1140*h* may be disposed adjacent to a boundary on one side surface and a boundary on the other side surface of an electronic device 700*h* on a set substrate 600*h* of the electronic device 700*h*. A communication module 610*h* and a baseband circuit 620*h* may further be disposed on the set substrate 600*h*. The plurality of antenna modules may be electrically connected to the communication module 610*h* and/or the baseband circuit 620*h* via a coaxial cable 630*h*.

Referring to FIG. 10C, a plurality of antenna modules each including an antenna apparatus 100*i* and a patch antenna pattern 1110*i* may be disposed adjacent to centers of sides of a polygonal electronic device 700*i* on a set substrate 600*i*. A communication module 610*i* and a baseband circuit 620*i* may further be disposed on the set substrate 600*i*. The antenna apparatus and the antenna module may be electrically connected to the communication module 610*i* and/or the baseband circuit 620*i* through a coaxial cable 630*i*.

In the example embodiments, conductive layers, ground planes, feed lines, feed vias, dipole antenna patterns, patch antenna patterns, shielding vias, director patterns, electrical connection structures, plating members, core vias, and blocking patterns may include a metal material (e.g., conductive materials such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD), a physical vapor deposition (PVD), a sputtering process, a subtractive process, an additive process, a semi-additive process, a modified semi-additive process (MSAP), and the like, but the material and the plating method are not limited thereto.

The dielectric layer and/or the insulating layer described in the aforementioned example embodiments may be a thermosetting resin such as an FR4, a liquid crystal polymer (LCP), a low temperature co-fired ceramic (LTCC), an epoxy resin, a thermoplastic resin such as a polyimide resin, a resin in which the thermosetting resin or the thermoplastic resin is mixed with an inorganic filler or is impregnated together with an inorganic filler in a core material such as a glass fiber (a glass fiber, a glass cloth, and a glass fabric), prepreg, ajinomoto build-up film (ABF), FR-4, bismaleimide triazine (BT), a photo imageable dielectric (PID) resin, a copper clad laminate (CCL), a glass or ceramic based insulating material, or the like. The insulating layer may fill at least a portion of a position in the antenna apparatus described in example embodiments in which a conductive layer, a ground plane, a feed line, a feed via, a dipole antenna pattern, a patch antenna pattern, a shielding via, a director pattern, an electrical connection structure, a plating member, a core via, and a blocking pattern are not disposed.

An RF signal described in the aforementioned example embodiments may have a form based on Wi-Fi (IEEE 802.11 family, and the like), WiMAX (IEEE 802.16 family, and the like), IEEE 802.20, LTE (long term evolution), Ev-DO, HSPA+, HSDPA+, HSUPA+, EDGE, GSM, GPS, GPRS, CDMA, TDMA, DECT, Bluetooth, 3G, 4G, 5G, and other latest random wireless and wired protocols, but the RF signal is not limited to the provided examples.

According to the aforementioned example embodiments, by additionally providing elements related to designing a resonance frequency of the dipole antenna without a substantial increase in overall size, a bandwidth may be broadened, and by providing a structure in which a radial pattern of the dipole antenna may be accurately adjusted, a gain and/or directivity may improve.

The communication modules 610*g*, 610*h*, and 610*i* in FIGS. 10A, 10B, and 10C that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a first dipole antenna pattern;

a feed line electrically connected to the first dipole antenna pattern; and a first ground plane disposed rearward of the first dipole antenna pattern and rearwardly spaced apart from the first dipole antenna pattern, wherein the first ground plane forms a step-type cavity rearwardly spaced apart from the first dipole antenna pattern, and a width of a rear portion of the step-type cavity in a lateral direction is different from a width of a front portion of the step-type cavity in the lateral direction, and wherein the first dipole antenna pattern does not overlap the step-type cavity in the lateral direction.

2. The antenna apparatus of claim 1, further comprising:

a second ground plane disposed above or below the first ground plane and forming the step-type cavity; and shielding vias disposed along a front boundary line of the first ground plane and electrically connected to the second ground plane.

3. The antenna apparatus of claim 2, further comprising:

a first blocking pattern disposed outside of the step-type cavity and extending from the first ground plane to a region in front of the first ground plane; and a second blocking pattern disposed in outside of the step-type cavity and extending from the second ground plane to a region in front of the second ground plane, and overlapping the first blocking pattern in upward and downward directions.

4. The antenna apparatus of claim 1, further comprising:

a third ground plane disposed above or below the first ground plane and forming the step-type cavity;

a second dipole antenna pattern disposed above or below the first dipole antenna pattern; and a radial via electrically connecting the first dipole antenna pattern and the second dipole antenna pattern to each other.

5. The antenna apparatus of claim 4, further comprising:

a first feed via electrically connecting the feed line and the first dipole antenna pattern; and a director pattern disposed in the front of the second dipole antenna pattern and spaced apart from the second dipole antenna pattern, wherein a front region of the first dipole antenna pattern overlapping the director pattern in upward and downward directions is filled with an insulating layer.

6. The antenna apparatus of claim 1, wherein the step-type cavity is configured such that virtual extension lines of side boundary lines in the rear portion of the step-type cavity intersect the first dipole antenna pattern.

7. The antenna apparatus of claim 6, further comprising:

a director pattern disposed in front of the first dipole antenna pattern and spaced apart from the first dipole antenna pattern, wherein the step-type cavity is configured such that the virtual extension lines of the side boundary lines in the rear portion of the step-type cavity intersect the director pattern.

8. The antenna apparatus of claim 7, wherein the step-type cavity is configured such that virtual extension lines of side boundary lines in the front portion of the step-type cavity intersect the first dipole antenna pattern and do not intersect the director pattern.

9. The antenna apparatus of claim 8, further comprising:

a first blocking pattern disposed outside of the step-type cavity and extending further than the feed line in the first ground plane.

10. The antenna apparatus of claim 1, wherein lengths of side boundary lines in the front portion of the step-type cavity are shorter than lengths of side boundary lines in the rear portion of the step-type cavity.

11. The antenna apparatus of claim 1, wherein the first ground plane protrudes from a region between side boundary lines in the rear portion of the step-type cavity, and protrudes further than the side boundary lines in the rear portion of the step-type cavity.

12. The antenna apparatus of claim 1, further comprising:

a fourth ground plane disposed above the first ground plane, overlapping the step-type cavity in upward downward directions, and including a through-hole;

a patch antenna pattern disposed above of the fourth ground plane; and a second feed via electrically connected to the patch antenna pattern and penetrating the through-hole.

13. An antenna apparatus, comprising:

a first dipole antenna pattern;

a feed line electrically connected to the first dipole antenna pattern; and a first ground plane disposed rearward of the first dipole antenna pattern and rearwardly spaced apart from the first dipole antenna pattern, wherein the first ground plane forms first and second cavities recessed rearwardly into the first ground plane and having a T shape and an L shape, respectively.

14. The antenna apparatus of claim 13, further comprising:

a second ground plane disposed above or below the first ground plane and forming the first and second cavities; and shielding vias arranged along a front boundary line of the first ground plane and electrically connected to the second ground plane.

15. The antenna apparatus of claim 13, further comprising:

a third ground plane disposed above or below the first ground plane and forming the first and second cavities;

a second dipole antenna pattern disposed above or below the first dipole antenna pattern; and a radial via electrically connecting the first dipole antenna pattern and the second dipole antenna pattern to each other.

16. The antenna apparatus of claim 13, further comprising:

a fourth ground plane disposed above the first ground plane, overlapping the first and second cavities in upward and downward directions, and including a through-hole;

a patch antenna pattern disposed above the fourth ground plane; and a second feed via electrically connected to the patch antenna pattern and penetrating the through-holes.

17. The antenna apparatus of claim 16, further comprising protrusions disposed in the cavity at a central region of one or more of the edge portions.

18. The antenna apparatus of claim 16, wherein the cavity has a step shape in a plane of the first and second horizontal directions.

19. An antenna apparatus, comprising:

a dipole antenna pattern;

a feed line electrically connected to the first dipole antenna pattern; and vertically stacked ground layers spaced apart from the dipole antenna pattern in a first horizontal direction, and comprising edge portions forming a cavity facing the dipole antenna pattern, wherein the cavity comprises a first cavity portion spaced apart from the dipole antenna pattern in the first horizontal direction, and a second cavity portion disposed between dipole antenna pattern and the first cavity portion in the first horizontal direction and spaced apart from the dipole antenna pattern in the first horizontal direction, wherein a width of the second cavity portion in a second horizontal direction perpendicular to the first horizontal direction is greater than a width of the first cavity portion in the second horizontal direction, and wherein the dipole antenna pattern does not overlap the first cavity and the second cavity in the second horizontal direction.

20. The antenna apparatus of claim 19, further comprising protrusions disposed at opposite sides of one or more of the edge portions, wherein the protrusions define the second cavity portion.

* * * * *